US010772438B2

(12) United States Patent
Griffith et al.

(10) Patent No.: US 10,772,438 B2
(45) Date of Patent: Sep. 15, 2020

(54) AIR SYSTEM FOR A BED

(71) Applicant: Sleep Number Corporation, Minneapolis, MN (US)

(72) Inventors: Matthew Griffith, Buffalo, MN (US); Natalie Negus, Minneapolis, MN (US); Eric Rose, Easley, SC (US); Kody Lee Karschnik, Maple Grove, MN (US)

(73) Assignee: Sleep Number Corporation, Minneapolis, MN (US)

( * ) Notice: Subject to any disclaimer, the term of this patent is extended or adjusted under 35 U.S.C. 154(b) by 306 days.

(21) Appl. No.: 15/684,503

(22) Filed: Aug. 23, 2017

(65) Prior Publication Data

US 2019/0059603 A1 Feb. 28, 2019

(51) Int. Cl.
*A47C 21/04* (2006.01)
*A47C 20/04* (2006.01)
(Continued)

(52) U.S. Cl.
CPC ..... *A47C 21/044* (2013.01); *A47C 20/04* (2013.01); *A47C 21/048* (2013.01); *A47C 27/06* (2013.01); *A47C 27/083* (2013.01); *A47C 27/18* (2013.01)

(58) Field of Classification Search
CPC ..... A47C 21/02; A47C 21/04; A47C 21/042; A47C 21/044; A47C 21/048;
(Continued)

(56) References Cited

U.S. PATENT DOCUMENTS 4,057,861 A * 11/1977 Howorth ..... A47C 21/044 5/726
4,391,009 A 7/1983 Schlid et al.
(Continued)

FOREIGN PATENT DOCUMENTS

DE 3320771 12/1984
EP 1142515 10/2001
(Continued)

OTHER PUBLICATIONS

U.S. Appl. No. 14/885,751, filed Oct. 16, 2015, Palashewski et al.
(Continued)

*Primary Examiner* — Robert G Santos
*Assistant Examiner* — Alison N Labarge
(74) *Attorney, Agent, or Firm* — Fish & Richardson P.C.

(57) ABSTRACT

An air system for a bed can include a layer assembly having a head end, a foot end, and first and second sides, with a head portion near the head end, a foot portion near the foot end, and a middle portion between the head portion and the foot portion, the layer assembly. The layer assembly can have a spacer layer comprising spacer material configured to allow for air flow through the spacer material and a cover comprising a cover top layer and a cover bottom layer. The air system can have a distribution manifold that is substantially fan-shaped with a plurality of ribs defining channels and/or is positioned above the cover bottom layer and under the spacer layer. The air system can have first and second flaps with first and second retention features extending from the head and foot ends of the air layer.

21 Claims, 15 Drawing Sheets

(51) Int. Cl.
*A47C 27/06* (2006.01)
*A47C 27/08* (2006.01)
*A47C 27/18* (2006.01)

(58) Field of Classification Search
CPC ..... A47C 27/083; A47C 27/18; A47C 27/06; A47C 20/04; A47G 9/0215; A47G 9/023; A61G 7/05748; A61G 7/05792; A61G 2210/70; A47L 9/242; F24F 7/065
See application file for complete search history.

(56) References Cited

U.S. PATENT DOCUMENTS 4,625,998 A * 12/1986 Draudt ..... A47L 9/242 285/110
4,766,628 A 8/1988 Greer et al.
4,788,729 A 12/1988 Greer et al.
4,796,316 A 1/1989 Boselli
D300,194 S 3/1989 Walker
4,827,230 A 5/1989 Voss
4,829,616 A 5/1989 Walker
4,853,992 A * 8/1989 Yu ..... A47C 7/74 5/423
4,862,921 A 9/1989 Hess
4,890,344 A 1/1990 Walker
4,897,890 A 2/1990 Walker
4,908,895 A 3/1990 Walker
D313,973 S 1/1991 Walker
4,991,244 A 2/1991 Walker
5,144,706 A 9/1992 Walker et al.
5,170,522 A 12/1992 Walker
5,473,783 A 12/1995 Allen
D368,475 S 4/1996 Scott
5,509,154 A 4/1996 Shafer et al.
5,564,140 A 10/1996 Shoenhair et al.
5,642,546 A 6/1997 Shoenhair
5,652,484 A 7/1997 Shafer et al.
5,765,246 A 6/1998 Shoenhair
5,882,349 A 3/1999 Wilkerson et al.
5,903,941 A 5/1999 Shafer et al.
5,904,172 A 5/1999 Gifft et al.
5,921,858 A 7/1999 Kawai et al.
6,037,723 A 3/2000 Shafer et al.
6,102,936 A 5/2000 Augustine
6,108,844 A 8/2000 Kraft et al.
6,161,231 A 12/2000 Kraft et al.
6,202,239 B1 3/2001 Ward et al.
6,210,427 B1 4/2001 Augustine et al.
6,336,237 B1 1/2002 Schmid
6,397,419 B1 6/2002 Mechache
6,483,264 B1 11/2002 Shafer et al.
6,493,889 B2 12/2002 Kocurek et al.
6,497,720 B1 12/2002 Augustine et al.
6,511,501 B1 1/2003 Augustine et al.
6,546,576 B1 4/2003 Lin
RE38,128 E 6/2003 Gallup et al.
6,596,018 B2 7/2003 Endo et al.
6,686,711 B2 2/2004 Rose et al.
6,708,357 B2 3/2004 Gaboury et al.
6,763,541 B2 7/2004 Mahoney et al.
6,804,848 B1 10/2004 Rose
6,832,397 B2 12/2004 Gaboury
D502,929 S 3/2005 Copeland et al.
6,883,191 B2 5/2005 Gaboury et al.
7,036,163 B2 5/2006 Schmid
7,296,315 B2 11/2007 Totten et al.
7,389,554 B1 6/2008 Rose
7,469,432 B2 12/2008 Chambers
7,475,464 B2 1/2009 Lofy
7,480,950 B2 1/2009 Feher
7,480,953 B2 1/2009 Romano et al.
7,587,901 B2 9/2009 Petrovski
7,591,507 B2 9/2009 Giffin et al.
7,617,555 B2 11/2009 Romano et al.
7,640,754 B2 1/2010 Wolas
7,665,803 B2 2/2010 Wolas
7,708,338 B2 5/2010 Wolas
7,712,164 B2 5/2010 Chambers
RE41,765 E 9/2010 Gregory et al.
7,827,805 B2 11/2010 Comiskey et al.
7,865,988 B2 1/2011 Koughan et al.
7,877,827 B2 2/2011 Marquette et al.
7,908,687 B2 3/2011 Ward et al.
7,913,332 B1 3/2011 Barnhart
7,914,611 B2 3/2011 Vrzalik et al.
7,937,789 B2 5/2011 Feher
7,963,594 B2 6/2011 Wolas
7,966,835 B2 6/2011 Petrovski
7,975,331 B2 7/2011 Flocard et al.
7,996,936 B2 8/2011 Marquette
8,065,763 B2 11/2011 Brykalski et al.
8,118,920 B2 2/2012 Vrazlik et al.
8,143,554 B2 3/2012 Lofy
8,181,920 B2 5/2012 Brykalski
8,191,187 B2 6/2012 Brykalski et al.
8,220,090 B2 7/2012 Gowda
8,222,511 B2 7/2012 Lofy
8,256,236 B2 9/2012 Lofy
8,282,452 B2 10/2012 Grigsby et al.
8,332,975 B2 12/2012 Brykalski
8,336,369 B2 12/2012 Mahoney
8,402,579 B2 3/2013 Marquette et al.
8,418,286 B2 4/2013 Brykalski
8,434,314 B2 5/2013 Comiskey
8,444,558 B2 5/2013 Young et al.
8,516,842 B2 8/2013 Petrovski
8,539,624 B2 9/2013 Terech
D691,118 S 10/2013 Ingham et al.
D697,874 S 1/2014 Stusynski et al.
D698,338 S 1/2014 Ingham
8,621,687 B2 1/2014 Brykalski et al.
D701,536 S 3/2014 Sakal
8,672,853 B2 3/2014 Young
8,769,747 B2 7/2014 Mahoney et al.
8,893,339 B2 11/2014 Fleury
8,931,329 B2 1/2015 Mahoney et al.
8,950,025 B2 * 2/2015 Kaminski, Jr. ..... A47C 20/021 5/485
8,966,689 B2 3/2015 McGuire et al.
8,973,183 B1 3/2015 Palashewski et al.
8,978,648 B2 * 3/2015 Formica ..... F16L 11/111 128/204.18
8,984,687 B2 3/2015 Stusynski et al.
D737,250 S 8/2015 Ingham et al.
9,131,781 B2 * 9/2015 Zaiss ..... A47C 21/044
9,370,457 B2 6/2016 Nunn et al.
9,392,879 B2 7/2016 Nunn et al.
9,510,688 B2 12/2016 Nunn et al.
9,730,524 B2 8/2017 Chen et al.
9,737,154 B2 8/2017 Mahoney et al.
9,770,114 B2 9/2017 Brosnan et al.
2003/0145380 A1 8/2003 Schimd
2005/0086739 A1 * 4/2005 Wu ..... A47C 7/744 5/423
2005/0278863 A1 12/2005 Bahash et al.
2007/0033733 A1 2/2007 Jen
2008/0077020 A1 3/2008 Young et al.
2010/0101418 A1 * 4/2010 Augustine ..... A47C 21/044 95/273
2010/0174198 A1 7/2010 Young et al.
2011/0107514 A1 5/2011 Brykalski et al.
2011/0144455 A1 6/2011 Young et al.
2011/0258778 A1 10/2011 Brykalski et al.
2011/0289684 A1 * 12/2011 Parish ..... A47C 21/044 5/421
2011/0306844 A1 12/2011 Young
2012/0000207 A1 1/2012 Parish et al.
2012/0017371 A1 * 1/2012 Pollard ..... A47G 9/0215 5/423
2012/0144584 A1 6/2012 Vrazalik
2013/0139315 A1 * 6/2013 Pimenta ..... A47C 21/04 5/421
2013/0259965 A1 10/2013 Cloeren et al.
2013/0269106 A1 10/2013 Brykalski et al.

(56) References Cited

U.S. PATENT DOCUMENTS

| | | | | |
|---|---|---|---|---|
| 2014/0007656 | A1 | 1/2014 | Mahoney | |
| 2014/0182061 | A1 | 7/2014 | Zaiss | |
| 2014/0250597 | A1 | 9/2014 | Chen et al. | |
| 2014/0257571 | A1 | 9/2014 | Chen et al. | |
| 2014/0259417 | A1 | 9/2014 | Nunn et al. | |
| 2014/0259418 | A1 | 9/2014 | Nunn et al. | |
| 2014/0259431 | A1 | 9/2014 | Fleury | |
| 2014/0259433 | A1 | 9/2014 | Nunn et al. | |
| 2014/0259434 | A1 | 9/2014 | Nunn et al. | |
| 2014/0277611 | A1 | 9/2014 | Nunn et al. | |
| 2014/0277778 | A1 | 9/2014 | Nunn et al. | |
| 2014/0277822 | A1 | 9/2014 | Nunn et al. | |
| 2015/0007393 | A1 | 1/2015 | Palashewski | |
| 2015/0025327 | A1 | 1/2015 | Young et al. | |
| 2015/0026896 | A1 | 1/2015 | Fleury et al. | |
| 2015/0157137 | A1 | 6/2015 | Nunn et al. | |
| 2015/0157519 | A1 | 6/2015 | Stusynski et al. | |
| 2015/0182033 | A1 | 7/2015 | Brosnan et al. | |
| 2015/0182397 | A1 | 7/2015 | Palashewski et al. | |
| 2015/0182399 | A1 | 7/2015 | Palashewski et al. | |
| 2015/0182418 | A1 | 7/2015 | Zaiss | |
| 2015/0290059 | A1 | 10/2015 | Brosnan et al. | |
| 2015/0305523 | A1* | 10/2015 | Zimmermann ..... | A47G 9/023 5/486 |
| 2015/0366366 | A1 | 12/2015 | Zaiss et al. | |
| 2016/0100696 | A1 | 4/2016 | Palashewski et al. | |
| 2016/0192886 | A1 | 7/2016 | Nunn et al. | |
| 2016/0242562 | A1 | 8/2016 | Karschnik et al. | |
| 2016/0338871 | A1 | 11/2016 | Nunn et al. | |
| 2016/0367039 | A1 | 12/2016 | Young et al. | |
| 2017/0003666 | A1 | 1/2017 | Nunn et al. | |
| 2017/0035212 | A1 | 2/2017 | Nunn et al. | |
| 2017/0049243 | A1 | 2/2017 | Nunn et al. | |
| 2017/0196369 | A1 | 7/2017 | Nunn et al. | |
| 2017/0303697 | A1 | 10/2017 | Chen et al. | |
| 2017/0318980 | A1 | 11/2017 | Mahoney et al. | |

FOREIGN PATENT DOCUMENTS

| | | |
|---|---|---|
| JP | H06-81355 | 11/1994 |
| JP | H08-140808 | 6/1996 |
| WO | WO 1997/038607 | 10/1997 |
| WO | WO 2007/060371 | 5/2007 |
| WO | WO 2007/093783 | 8/2007 |
| WO | WO 2008/098945 | 8/2008 |
| WO | WO 2005/120295 | 12/2008 |
| WO | WO 2011/026040 | 3/2011 |

OTHER PUBLICATIONS

U.S. Appl. No. 15/337,034, filed Oct. 28, 2016, Karschnik et al.
U.S. Appl. No. 15/337,470, filed Oct. 28, 2016, Shakal et al.
U.S. Appl. No. 15/337,484, filed Oct. 28, 2016, Shakal.
U.S. Appl. No. 15/337,520, filed Oct. 28, 2016, Shakal et al.
U.S. Appl. No. 15/347,572, filed Nov. 9, 2016, Peterson et al.
U.S. Appl. No. 15/684,503, filed Aug. 23, 2017, Rose et al.
U.S. Appl. No. 15/687,796, filed Aug. 28, 2017, Brosnan et al.
U.S. Appl. No. 15/806,810, filed Nov. 8, 2017, Gaunt.
U.S. Appl. No. 15/807,002, filed Nov. 8, 2017, Peterson et al.
U.S. Appl. No. 29/577,797, filed Sep. 15, 2016, Karschnik et al.
U.S. Appl. No. 29/583,852, filed Nov. 9, 2016, Keeley.
U.S. Appl. No. 29/583,879, filed Nov. 9, 2016, Keeley et al.
International Preliminary Report on Patentability in International Application No. PCT/US2013/078106, dated Jul. 9, 2015, 11 pages.
International Search Report in Application No. PCT/US2013/078106, dated Mar. 11, 2014, 6 pages.
International Written Opinion in Application No. PCT/US2013/078106, dated Mar. 11, 2014, 9 pages.
Invitation to Pay Additional Fees and Partial Search Report in Application No. PCT/US2013/078106, dated Feb. 24, 2014, 6 pages.
Response filed May 9, 2014 to the International Search Report dated Mar. 11, 2014 in Application No. PCT/US2013/078106, 9 pages.
International Search Report and Written Opinion in International Application No. PCT/US2018/047743, dated Oct. 29, 2018, 12 pages.

* cited by examiner

AIR SYSTEM FOR A BED

The present document relates to bed systems, and more particularly to bed systems for delivering a flow of air to a user lying on the bed system.

BACKGROUND

In general, a bed is a piece of furniture used as a location to sleep or relax. Many modern beds include a soft mattress on a bed frame. The mattress may include springs, foam material, and/or an air chamber to support the weight of one or more occupants. Various features and systems have been used in conjunction with beds, including heating and cooling systems for heating and cooling a user of a bed.

SUMMARY

The present description provides an air system for delivering ambient or temperature-controlled air for a bed. The air system can include a distribution manifold. The distribution manifold can be substantially fan-shaped with a plurality of ribs defining channels. The distribution manifold can be positioned above the cover bottom layer and under the spacer layer. The air system can have first and second flaps with first and second retention features extending from the head and foot ends of the air layer. Further, the air system can include one or more other features described herein for increasing air flow or otherwise improving functionality of the air system.

In one aspect, an air system for a bed can include a layer assembly and a distribution manifold. The layer assembly can have a head end, a foot end, and first and second sides, where the layer assembly has a head portion near the head end, a foot portion near the foot end, and a middle portion between the head portion and the foot portion. The layer assembly can have a spacer layer comprising spacer material configured to allow for air flow through the spacer material and a cover including a cover top layer and a cover bottom layer. The cover substantially encloses the spacer layer with the cover top layer above the spacer layer and the cover bottom layer below the spacer layer. The distribution manifold extends through a portion of the cover and is positioned above the cover bottom layer and under the spacer layer so as to flow air from the distribution manifold to a space under the spacer layer, from the space under the spacer layer into the spacer layer, and from the spacer layer out through the cover top layer.

Implementations can include any, all, or none of the following features. The air system includes a first flap extending from the head end and having a first retention feature and a second flap extending from the foot end and having a second retention feature. The air system is sized and configured such that when the layer assembly is positioned on a mattress the first and second flaps are each sized and configured to wrap around opposite ends of the mattress and tuck under the mattress with the first and second retention features being positioned under the mattress to at least partially retain the layer assembly on the mattress. The layer assembly is configured to be positioned on a two-person mattress and sized to cover about half of a top surface of the mattress and the first and second flaps are suitable for retaining the layer assembly on the two-person mattress. The distribution manifold is connected to the layer assembly proximate the first side. The air system further includes one or more connectors connected to the layer assembly proximate the second side such that the one or more connectors are configured to connect the second side of the layer assembly to a side of a second layer assembly. The air system further includes a plurality of buttons connected to the layer assembly proximate the second side and positioned at least partially under the layer assembly and a plurality of loops positioned proximate the second side of the layer assembly. The plurality of loops are positioned with respect to the plurality of buttons such that the plurality of loops can connect to buttons of a second layer assembly that is configured similar to the layer assembly and the plurality of buttons can connect to loops of the second layer assembly so as to interconnect the layer assembly with the second layer assembly. A bed system includes an adjustable foundation, a mattress positioned on the adjustable foundation, and the air system such that the layer assembly is positioned on top of the mattress on a first side of the mattress with the second side of the layer assembly substantially aligned with a middle of the mattress and the distribution manifold is connected to the layer assembly at the first side of the layer assembly proximate a side of the mattress such that the distribution manifold hangs down along at least a portion of the side of the mattress. The air system further includes a first flap extending from the head end and having a first retention feature positioned under the mattress, a second flap extending from the foot end and having a second retention feature positioned under the mattress, an air engine configured to deliver air, and a hose assembly connecting the air engine to the layer assembly via the distribution manifold. The bed system further includes a mattress cover that at least partially covers the mattress, the layer assembly, the first flap, the second flap, and the distribution manifold. The air system further includes means for delivering air to the air layer. The air system further includes means for connecting the layer assembly to a bed. The air system further includes means for defining flow paths through the layer assembly. The distribution manifold includes a vertically-extending portion and a horizontally extending portion connected to the vertically-extending portion at a top of the vertically-extending portion, the vertically-extending portion defines a flow path with a larger cross-sectional area at the top of the vertically-extending portion than at a bottom of the vertically-extending portion, and the horizontally-extending portion defines a plurality of channels configured to deliver air received from the vertically-extending portion of the distribution manifold out into the layer assembly at different angles. The layer assembly further includes a lower spacer material positioned at the middle portion of the layer assembly under the spacer layer, the distribution manifold is positioned in the middle portion of the layer assembly at the first side of the layer assembly, and the distribution manifold is aligned with the lower spacer material such that at least part of the air blown out of the distribution manifold is blown into the lower spacer material. The lower spacer material is an elongated strip extending from a first lower spacer end proximate the distribution manifold to a second lower spacer end proximate the second side of the layer assembly, the spacer layer extends substantially from the head end to the foot end and from the first side to the second side of the layer assembly, and the lower spacer material is configured to receive air from the distribution manifold and allow air flow through the lower spacer material such that some air flows from the lower spacer material into the spacer layer proximate the second side of the layer assembly, some air flows from the lower spacer material into the spacer layer proximate the first side of the layer assembly, and some air flows from the lower spacer material into the spacer layer between the first and second sides of the layer assembly. The layer assembly further includes a lower spacer material positioned at the middle portion of the layer assembly under the spacer layer and the distribution manifold is thicker and wider than the lower spacer material such that some air from the distribution manifold flows under the lower spacer material, some air from the distribution manifold flows into the lower spacer material, and some air from the distribution manifold flow to the sides of the lower spacer material. The air system further includes an air engine and a hose assembly connecting the air engine to the layer assembly via the distribution manifold. The hose assembly has a substantially D-shaped cross section with a substantially straight portion opposite a curved portion such that the curved portion faces away from the layer assembly when the hose assembly is connected. The air system further includes means for connecting the hose assembly to the air engine to allow for the hose assembly to swivel with respect to the air engine and to decrease the chance of kinking of the hose assembly. The layer assembly further includes stitching extending through the cover top layer, the cover bottom layer, and the spacer layer in a pattern that defines flow paths from the distribution manifold. The stitching is patterned with one or more lines that cross the middle portion of the layer assembly so as to restrict flow from the distribution manifold at the first side to the second side of the layer assembly. The layer assembly further includes a lower spacer material positioned at the middle portion of the layer assembly that is aligned with the distribution manifold under the spacer layer. The layer assembly further includes stitching extending through the cover top layer, the cover bottom layer, and the spacer layer in a pattern that defines flow paths from the distribution manifold. The stitching is patterned with one or more lines that also stitch at least partially into the lower spacer material but without entirely crossing the lower spacer material.

In another aspect, an air system for a bed includes a layer assembly having a head end, a foot end, and first and second sides, with the layer assembly having a head portion near the head end, a foot portion near the foot end, and a middle portion between the head portion and the foot portion. The layer assembly includes a spacer layer including spacer material configured to allow for air flow through the spacer material, a cover including a cover top layer and a cover bottom layer, a first flap extending from the head end and having a first retention feature, and a second flap extending from the foot end and having a second retention feature. The cover substantially encloses the spacer layer with the cover top layer above the spacer layer and the cover bottom layer below the spacer layer, wherein the cover defines an air inlet into the layer assembly. The air system is sized and configured such that when the layer assembly is positioned on a mattress, the first and second flaps are each sized and configured to wrap around opposite ends of the mattress and tuck under the mattress with the first and second retention features being positioned under the mattress to at least partially retain the layer assembly on the mattress.

In another aspect, an air system for a bed includes a layer assembly having a head end, a foot end, and first and second sides, with the layer assembly having a head portion near the head end, a foot portion near the foot end, and a middle portion between the head portion and the foot portion. The layer assembly includes a spacer layer including spacer material configured to allow for air flow through the spacer material and a cover comprising a cover top layer and a cover bottom layer, wherein the cover substantially encloses the spacer layer with the cover top layer above the spacer layer and the cover bottom layer below the spacer layer. A distribution manifold extends through a portion of the cover at the first side and is substantially fan-shaped with a plurality of ribs defining channels so as to distribute air into the layer assembly toward the head portion, the middle portion, and the foot portion.

Other features, aspects and potential advantages will be apparent from the accompanying description and figures.

DESCRIPTION OF DRAWINGS

Like reference symbols in the various drawings indicate like elements.

DETAILED DESCRIPTION

In various embodiments described below, an air system can be used with a bed for delivering cooling, heating, or ambient air to control the temperature of a user lying on the air system. The air system can include one or more features that help increase air flow through the air system, thus improving user comfort while potentially using less energy. For example, a distribution manifold can have a fanned shape and/or be positioned under a spacer layer to increase air flow to certain parts of the air layer. An additional spacer material can be positioned under the spacer layer to help direct air from the distribution manifold across a user's body to the opposite side of the air layer. The air layer can have stitching that creates distribution channels oriented to allow flow to various parts of the air layer, and consequently, various parts of the user. An air engine can be connected via a hose assembly having structure to avoid air restrictions, such as a D-shaped cross-section that provides increased strength and/or a hose connection to reduce kinking. The air layer can be sized to cover only half of a two person bed, which can allow for increased comfort for the user by not requiring the air system to blow air to the entire bed. Having an air layer sized to cover only half of the bed also allows for two separate air layers to be positioned on the same bed, which can allow two users to control temperature to their own unique preferences. The air system can include flaps with retention features to hold the air layer in place, which can be suitable for retaining the air layer on a mattress even when only one air layer is positioned on a two person bed. Additional connectors, such as buttons and loops, can be employed to connect two air layers side-by-side. Some or all of these features can be combined for an air system having improved air flow and/or other functionality as further described in some of the following examples.

Figure 1:
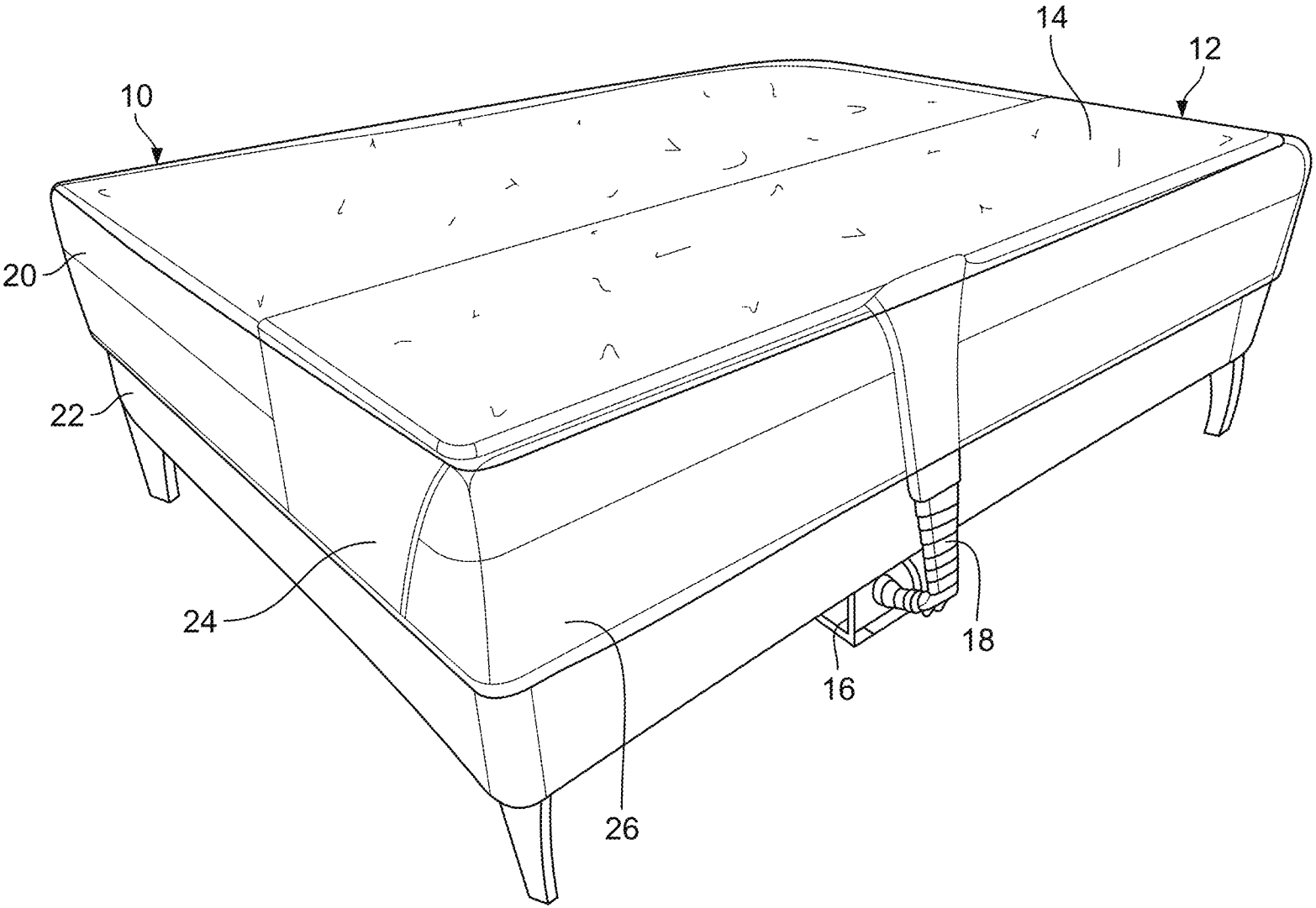
FIG. 1 is a perspective view an example bed and air system used in conjunction with the bed.

FIG. 1 is a perspective view one example of an example bed 10 and an air system 12 used in conjunction with the bed 10. The air system 12 shown in the example of FIG. 1 can include a layer assembly 14, an engine 16, and a hose assembly 18 connecting the layer assembly 14 to the engine 16. The air system 12 can be used in conjunction with the bed 10 to provide warm, cool, and/or ambient air to a user resting on the air system 12 and the bed 10.

In the illustrated embodiment, the bed 10 includes a mattress 20 and a foundation 22. In some embodiments, the mattress 20 can be an air mattress having an inflatable air chamber and a controller for controlling inflation of the inflatable air chamber. In other embodiments, the mattress 20 need not include an air chamber. For example, in some embodiments the mattress 20 can include foam and/or springs instead of or in addition to an inflatable air chamber. In those embodiments in which the mattress 20 is an air mattress, the air system 12 can be independent from the mattress 20, with the engine 16 dedicated to the air system 12 and the mattress 20 having its own inflation controller.

The foundation 22 is positioned under the mattress 20 to support the mattress 20. In some embodiments, the foundation 22 can be an adjustable foundation with one or more articulable sections, such as for raising the head and foot of the foundation 22 and the mattress 20. In other embodiments, the foundation 22 can be a stationary foundation.

In the illustrated embodiment, the layer assembly 14 of the air system 12 is positioned on a top surface of the mattress 20 so that when a user lies on the bed 10, the layer assembly 14 is positioned between the user and the mattress 20. The engine 16 delivers air from the engine 16 through the hose assembly 18 to the layer assembly 14 which distributes that air up through the top of the layer assembly 14 to the user laying on the layer assembly 14.

In some embodiments, the engine 16 can be a blower or air pump for blowing ambient air through the hose assembly 18 and layer assembly 14. Such ambient air can be used to cool the user lying on the layer assembly 14 due to ambient air being typically lower than the body temperature of the user and due to evaporation of perspiration by the user.

In some embodiments, the engine 16 can include a cooling unit to cool the air before delivering the air through the hose assembly 18 and the layer assembly 14. In such embodiments, the cooler air can further cool a user lying on the layer assembly.

In some embodiments, the engine 16 can include a heating unit to heat the air before delivering the air through the hose assembly 18 and the layer assembly 14. In such embodiments, the engine 16 can warm users that feel too cool. In various embodiments, the engine 16 can be configured to provide warm, cool, and/or ambient air as desired by the user.

The air system 12 can include a connector such as flaps 24 to connect the layer assembly 14 to the bed 10. The air system 12 can have a first flap 24 extending from a foot end of the layer assembly 14 to be tucked under the foot of the mattress 20, between the mattress 20 and the foundation 22. The air system 12 can also have a second flap 24 (not shown in FIG. 1) extending from a head end of the layer assembly 14 to be tucked under the head of the mattress 20, between the mattress 20 and the foundation 22. The flaps 24 can have one or more retention features, such as hook-and-loop style fasteners commonly sold under the brand name VELCRO.

In the embodiment illustrated in FIG. 1, the air system 12 can be positioned under a fitted sheet 26 or other mattress cover that covers the mattress 20, the flaps 24, and at least part of the hose assembly 18. The hose assembly 18 can be sized and shaped to be relatively wide and flat so as to fit in a relatively narrow gap between the fitted sheet 26 and the mattress 20.

Figure 2A:
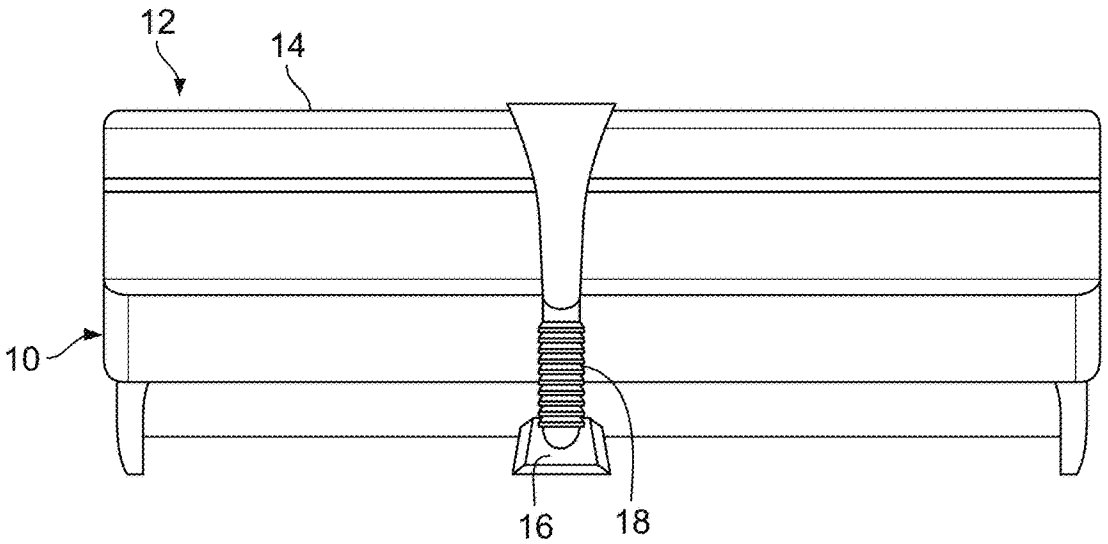
FIGS. 2A and 2B are side views of beds of different sizes with the air system.
Figure 2B:
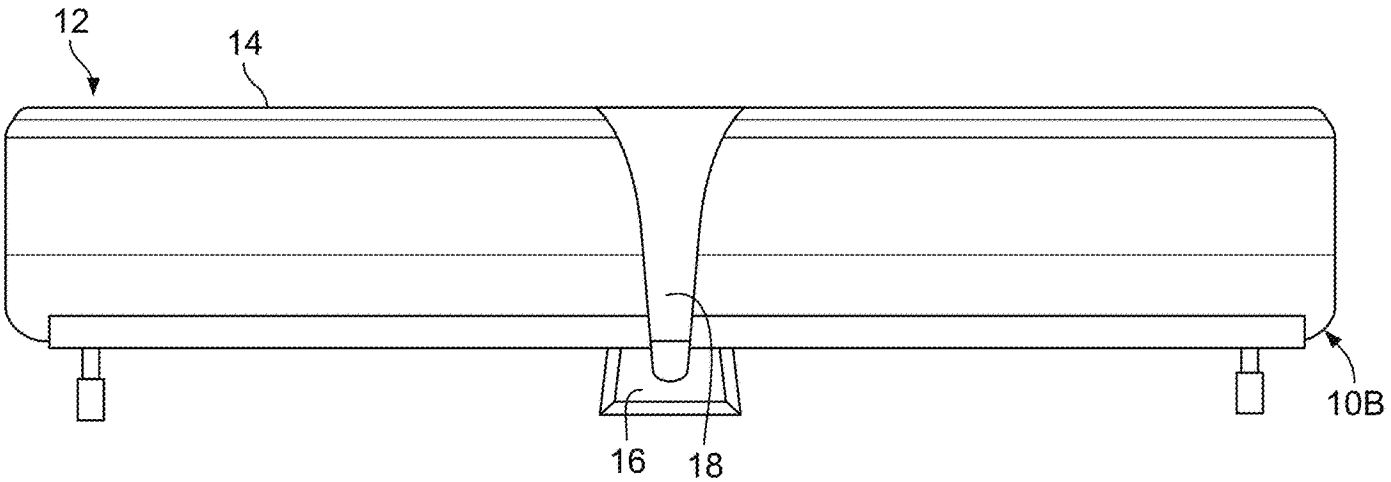

FIGS. 2A and 2B are side views of beds 10 and 10B of different sizes with the air system 12. FIG. 2A shows the air system 12 on the bed 10 which is a relatively high-profile bed. The hose assembly 18 can stretch as shown to accommodate the height of the bed 10. FIG. 2B shows the air system 12 on the bed 10B which is a relatively low-profile bed. The hose assembly 18 can contract as shown such that the air system 12 works suitably with beds having high, low, and medium profiles. In other embodiments, the hose assembly 18 can be a retractable hose assembly.

Figure 3:
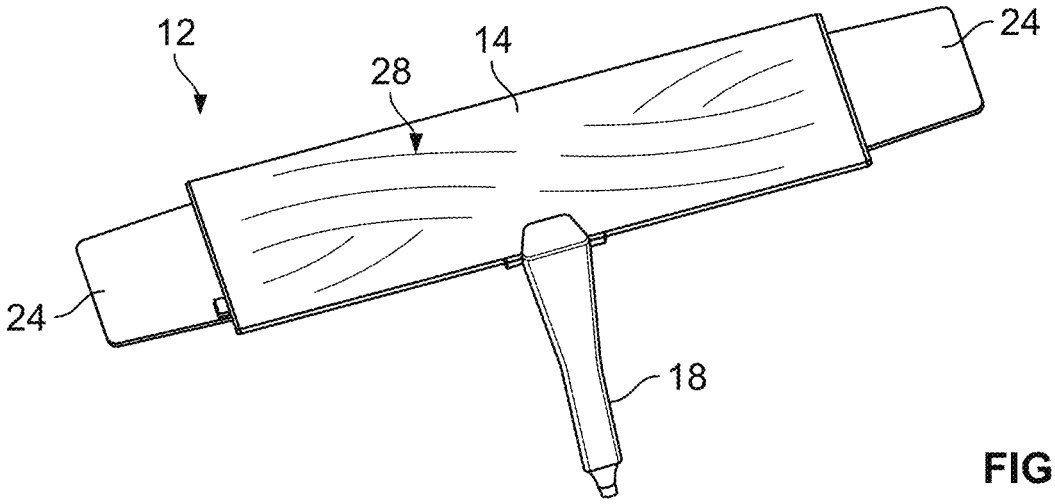
FIG. 3 is a perspective view of a layer assembly and a hose assembly of the air system.
Figure 4:
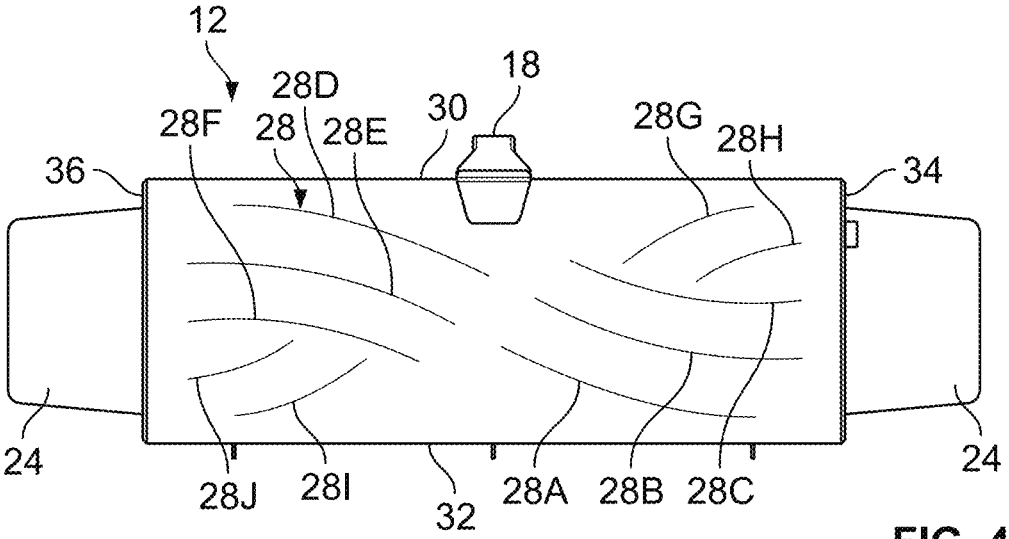
FIG. 4 is a top view of the layer assembly of the air system.

FIG. 3 is a perspective view of the layer assembly 14 and the hose assembly 18 of the air system 12. FIG. 4 is a top view of the layer assembly 14 of the air system 12. FIGS. 3 and 4 show the layer assembly having stitching 28 extending through the layer assembly 14 to define flow paths though the layer assembly 14 between the stitching 28. The stitching 28 can help direct air flowing through the layer assembly 14 to different parts of the layer assembly, including parts near a proximal side 30, an distal side 32, an end 34, and an end 36.

FIGS. 3 and 4 show one embodiment of a pattern of stitching 28 having stitchings 28A-28J. The layer assembly 14 can include three relatively long stitchings 28A-28C extending from near a middle of the layer assembly 14 to near the end 34. The stitchings 28A-28C can curve as illustrated to direct air toward the end 34 and the distal side 32. The layer assembly 14 can include three relatively long stitchings 28D-28F extending from near a middle of the layer assembly 14 to near the end 36. The stitchings 28D-28F can curve as illustrated to direct air toward the end 36 and the proximal side 30.

The layer assembly 14 can include two relatively short stitchings 28G-28H extending from near the stitching 28C to near the end 34. The stitchings 28G-28H can curve as illustrated to direct air toward the end 34 and the proximal side 30. The layer assembly 14 can include two relatively short stitchings 28I-28J extending from near the stitching 28F to near the end 36. The stitchings 28I-28J can curve as illustrated to direct air toward the end 36 and the distal side 32.

The stitchings 28A-28C and 28G-28H can be spaced from the stitchings 28D-28F and 28I-28J to form a channel extending from the hose assembly 18 at the proximal side 30 to the distal side 32. Accordingly, the stitching 28 can be one suitable pattern that partially allows and partially restricts flow so as to supply air to various parts of the layer assembly 14.

Figure 5:
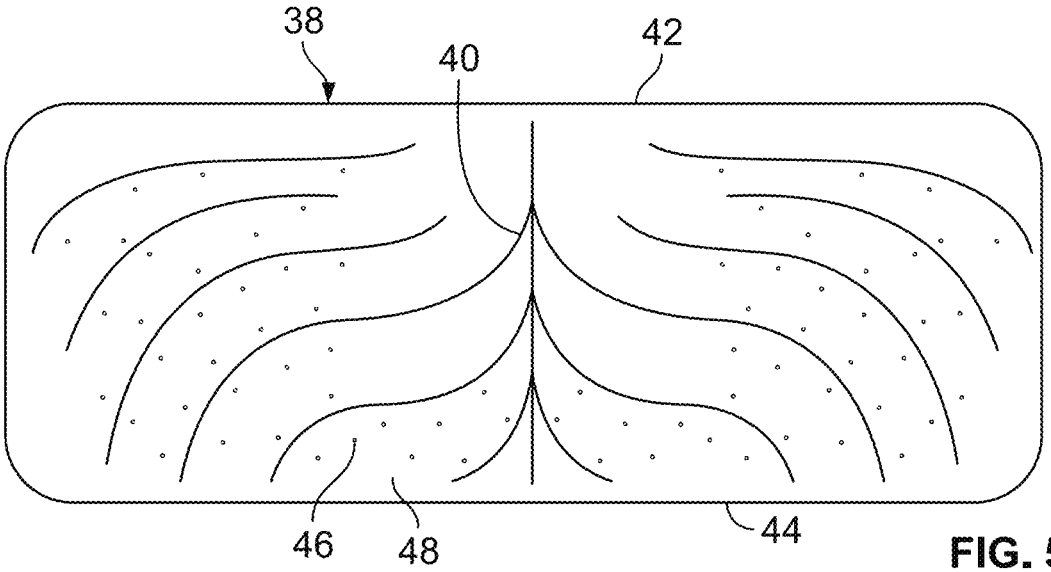
FIG. 5 is a top view of an alternative embodiment of the layer assembly having an alternative stitching pattern.

FIG. 5 is a top view of a layer assembly 38, which is an alternative embodiment of the layer assembly 14. The layer assembly 38 has an alternative pattern of stitching 40. The stitching 40 can fan out from a center of the layer assembly 38 with curved lines substantially illustrated. The stitching 40 can be substantially symmetrical about a centerline of the layer assembly 38. The stitching 40 can have lines that meet at a center of the layer assembly 38 so as to restrict flow from a proximal side 42 to a distal side 44. The layer assembly 38 can include holes 46 in a top layer 48 of the layer assembly 38 to allow air flow from the layer assembly 38 out. In the embodiment illustrated in FIG. 5, the holes are positioned in a pattern with more holes 46 near the distal side 44 and the ends of the layer assembly 38 and fewer or no holes 46 in an area near the proximal side 42 at the middle of the layer assembly 38.

Figure 6:
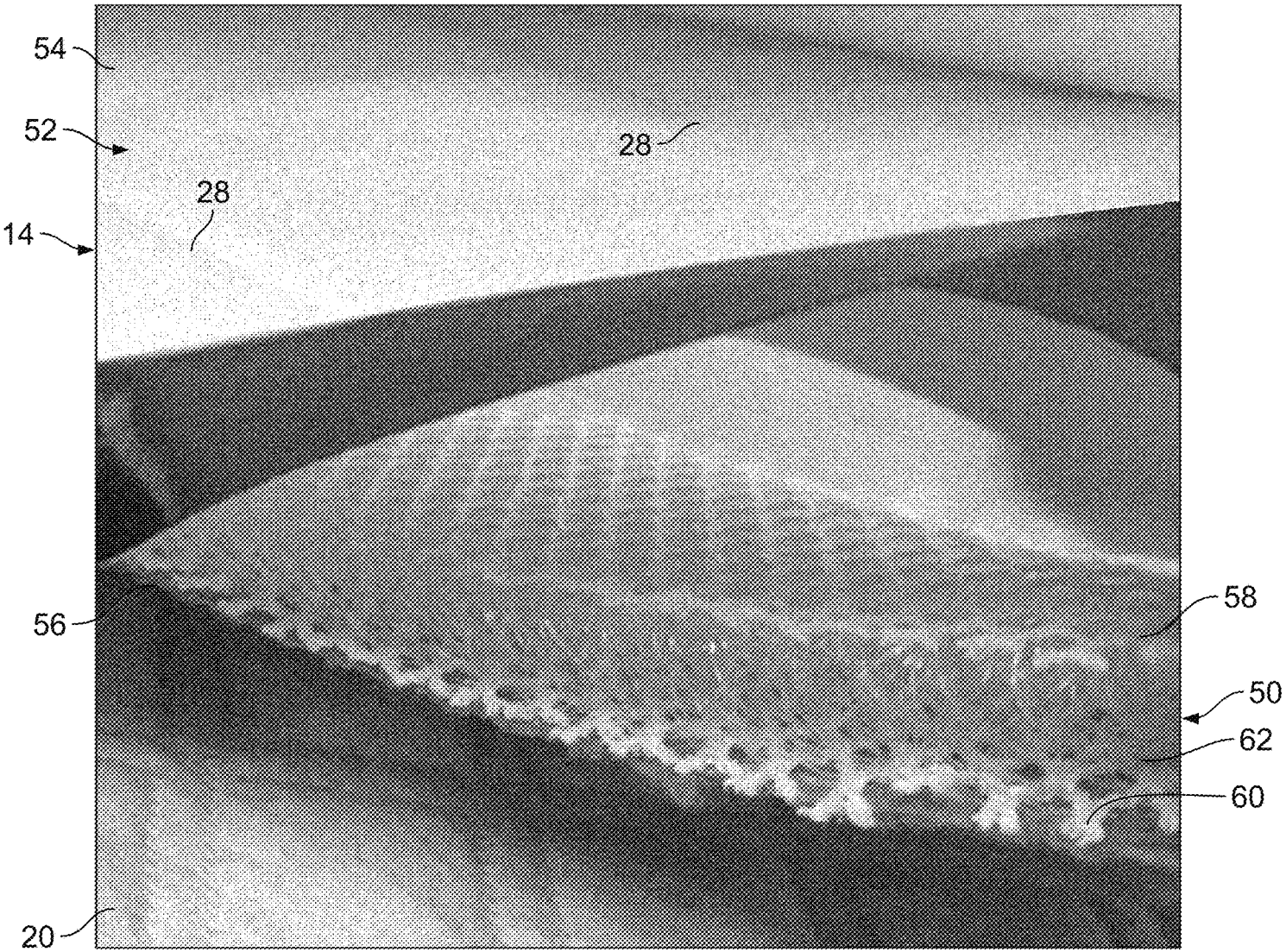
FIG. 6 is an enlarged view of the layer assembly, opened to show a spacer layer in the layer assembly.

FIG. 6 is an enlarged view of the layer assembly 14, opened to show a spacer layer 50 in the layer assembly 14 enclosed by a cover 52. The cover 52 includes a top layer 54 and a bottom layer 56 that combine to cover and enclose the spacer layer 50. The spacer layer 50 includes a top mesh 58, a bottom mesh 60, and monofilament strands 62 extending between the top mesh 58 and the bottom mesh 60. In some embodiments, the strands 62 can be randomly or substantially randomly placed to provide structural support to hold the top mesh 58 spaced from the bottom mesh 60 and to provide flow paths between the strands 62. In other embodiments, the strands 62 can be positioned in a pattern, such as rows. The top and bottom meshes 58 and 60

The stitching 28 of the layer assembly 14 can extend through both the cover 52 and the spacer layer 50, including the top layer 54, the top mesh 58, the monofilament strands 62, the bottom mesh 60, and the bottom layer 56. The stitching 28 can compress the spacer layer 50 to restrict air flow at the location of the stitching 28, while the spacer layer 50 can remain expanded at locations without the stitching 28 to allow air flow in channels between rows of the stitching 28.

In some embodiments, the cover 52 can be made of a relatively air tight material and can define a pattern of holes such that air flowing through the cover 52 is directed to and through locations having the holes. In other embodiments, the cover 52 can be air-permeable or semi-air-permeable. For example, in some embodiments the cover 52 can include a substantially air tight bottom layer 56 to restrict air from flowing down toward the mattress 20 and can include a substantially air permeable top layer 53 to allow air flow up toward a user.

Figure 7:
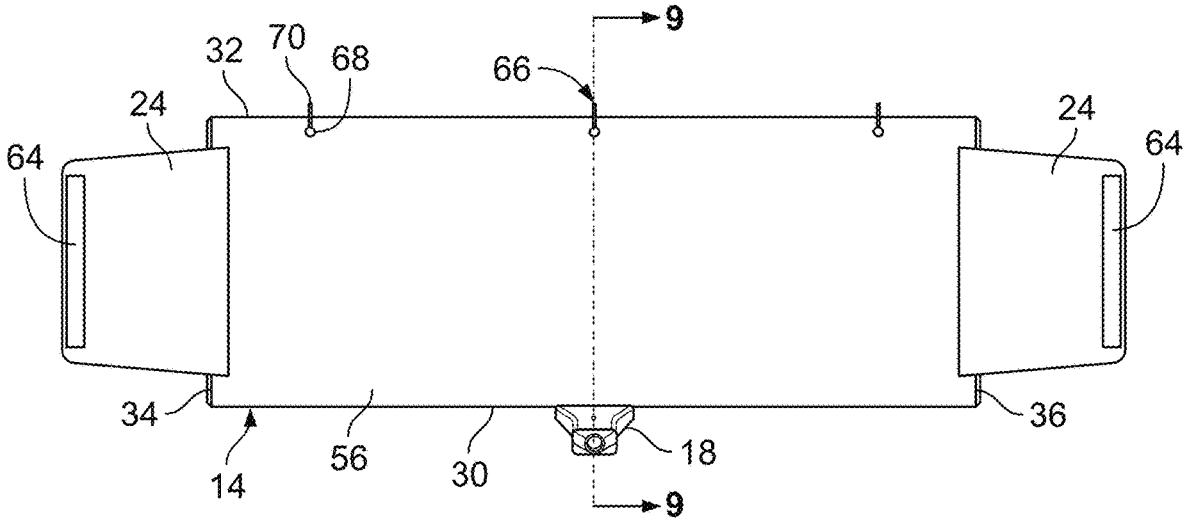
FIG. 7 is a bottom view of the layer assembly.

FIG. 7 is a bottom view of the layer assembly 14. FIG. 7 illustrates one embodiment of the flaps 24 extending from the ends 34 and 36 of the layer assembly 14. The flaps 24 can have strips of retention material 64, such as hook-and-loop style fasteners commonly sold under the brand name VELCRO. The retention material 64 can be positioned on a bottom side of the flaps 24 such that when the flaps 24 are wrapped around the mattress 20 (see FIG. 1), the retention material 64 can engage the fabric on the bottom side of the mattress 20 to help retain the layer assembly 14 in place on the mattress 20.

In some embodiments, the air system 12 and its layer assembly 14 can be used alone on one side of the mattress 20 with the other side of the mattress 20 having no layer assembly 14. FIG. 1 is one example of such an arrangement, which can be beneficial when two users sleep on the bed 10 but only one of the two users desire heating and/or cooling. In such arrangements, the second user can sleep directly on the mattress 20 (or on one or more sheets covering the mattress 20).

In other embodiments, two air systems 12 with two layer assemblies 14 can be used on the same bed 10. In that case, two layer assemblies can be positioned side-by-side with one dedicated for each user, which can allow each user to independently control the heating and/or cooling of his or her side of the bed 10 via the respective air systems 12.

As shown in FIG. 7, the air system 12 can include connectors 66 positioned at the distal side 32 of the layer assembly 14. The connectors 66 can connect one layer assembly 14 to a second layer assembly 14 when the two layer assemblies are positioned adjacent one-another on the mattress 20. By positioning the connectors 66 at the distal side 32 of each layer assembly 14, the hose assemblies 18 of the air systems 12 can hang off the sides of the mattress 20 when the distal sides 32 are positioned adjacent one-another and connected via the connectors 66.

In some embodiments, the connectors 66 can include buttons 68 and loops 70. Each air system 12 can include multiple locations, each with a button 68 and a loop 70. At each given location, the loop 70 of one air system 12 can connect to the button 68 of the adjacent air system 12 and the button 68 of the first air system 12 can connect to the loop 70 of the adjacent air system 12. Accordingly, there can be two loop-to-button connections at each location and there can be multiple connection locations total (there are three shown in FIG. 7).

In other embodiments, the connectors 66 can be different than as illustrated. For example, the connectors 66 can include some fastener other than buttons.

In embodiments having the connectors 66, the connectors 66 can help retain the layer assembly 14 in place in applications when the layer assembly 14 is used with a second layer assembly 14. In other embodiments, the layer assembly 14 can be retained in place with the flaps 24 or via features other than the connectors 66.

Figure 8:
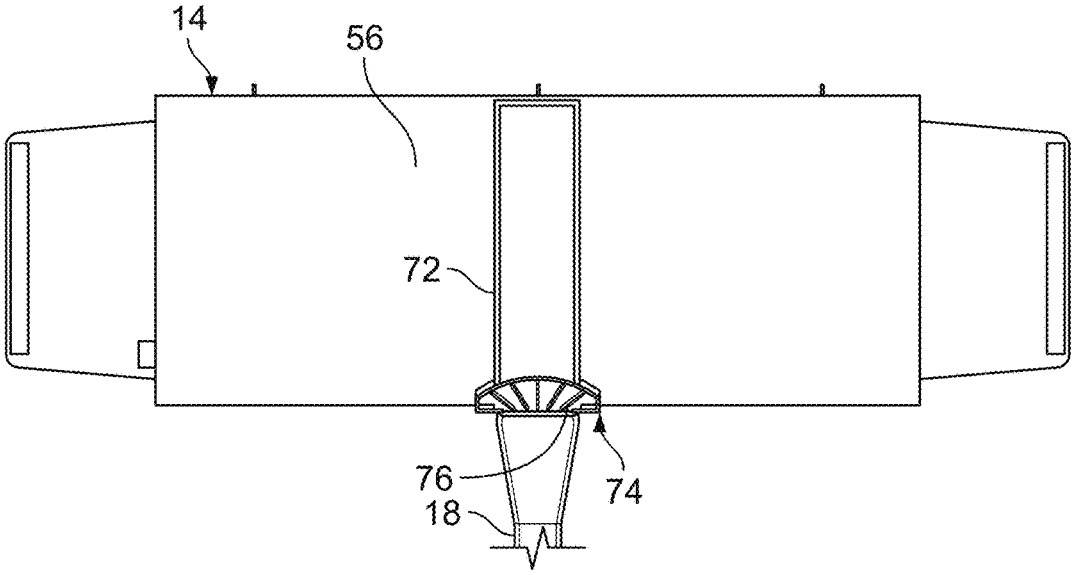
FIG. 8 is a top view of the layer assembly with portions removed to show components therein.

FIG. 8 is a top view of the layer assembly 14 with the top layer 54 of the cover 52 and the spacer layer 50 removed to show components therein. FIG. 8 shows the layer assembly 14 including the spacer layer 50, a spacer material 72, and a distribution manifold 74. The spacer material 72 and the distribution manifold 74 can be positioned within the layer assembly 14 under the spacer layer 50 so as to direct at least some of the air flow under the spacer layer 50 and across to the other side of a user's body lying on the layer assembly.

The spacer material 72 can be similar to the spacer layer 50. In some embodiments, the spacer material 72 can differ from the spacer layer 50 in certain ways. For example, the spacer material 72 can have monofilament strands 62 (shown in FIG. 6) that are thicker than those of the spacer layer 50, making the spacer material 72 relatively stiffer. The spacer material 72 can have its strands 62 positioned in rows so as to direct more airflow in a specific direction than embodiments of the spacer layer 50 having strands 62 positioned randomly. The spacer material 72 can be positioned only in a central portion of the layer assembly 14, such as at a location near a user's hips, while the spacer layer 50 can extend through all or substantially all of the layer assembly 14.

The distribution manifold 74 can be shaped as an arc or semi-circle with ribs 76 to direct air into the layer assembly 14 at different angles. The distribution manifold 74 can direct air toward the spacer material 72 as well as to the sides of the spacer material 72 under the spacer layer 50.

In some embodiments, the distribution manifold 74 can be wider than the spacer material 72. In other embodiments, the distribution manifold 74 can be about the same width as the spacer material 72. For example, the distribution manifold can be about 12 inches wide and the spacer material can be about 8 to 12 inches wide.

In some embodiments, the distribution manifold 74 and the ribs 76 can be made of a relatively soft and flexible material. For example, the distribution manifold 74 and the ribs 76 can be made of silicone. This can allow the distribution manifold 74 and the ribs 76 to be rigid enough to supply air to the layer assembly 14 but soft enough to produce little or no discomfort to a user laying on the layer assembly 14 at a location near or on the distribution manifold 74.

Figure 9:
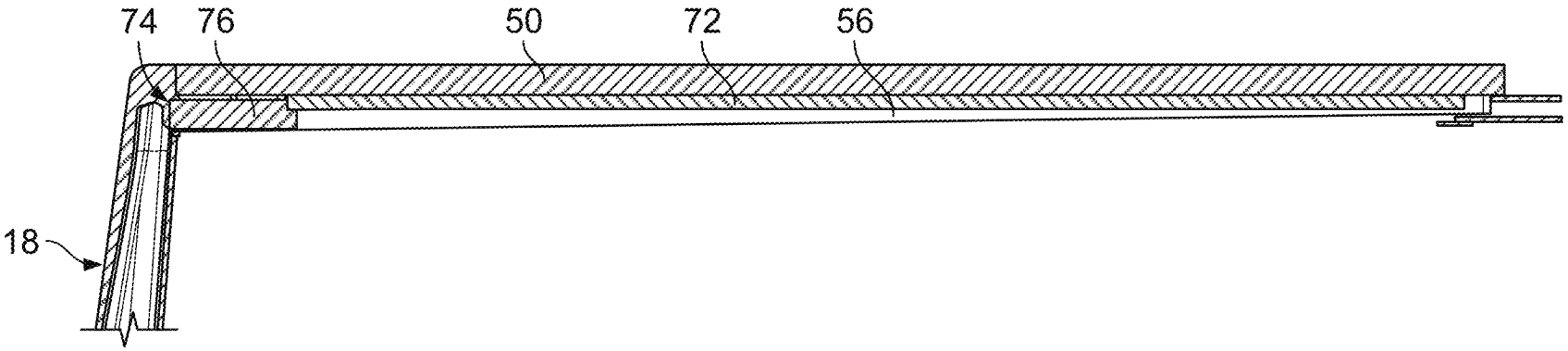
FIG. 9 is a sectional view of the layer assembly taken along line 9-9 of FIG. 7.

FIG. 9 is a sectional view of the layer assembly 14 and the hose assembly 18 taken along line 9-9 of FIG. 7. FIG. 9 shows the spacer material 72 and the distribution manifold 74 being positioned inside the cover 52 of the layer assembly 14 below the spacer layer 50. Air from the hose assembly 18 can be directed into the layer assembly 14 via the distribution manifold 74. The distribution manifold 74 can direct some air into the spacer material 72, some air into the space between the spacer material 72 and the bottom layer 56 of the cover 52, and some air into the space between the spacer layer 50 and the bottom layer 56 of the cover 52. Air directed under the spacer material 72, through the spacer material 72 and under the spacer layer 50 (to the sides of the spacer material 72) can all ultimately be directed up through the spacer layer 50 and up through the top of the layer assembly 14 to cool or heat the user.

In some embodiments, the spacer material 72 can be thinner than the spacer layer 50 and the distribution manifold 74. For example, in some embodiments the spacer material 72 can be about 10 mm thick and the spacer layer 50 can be about 20 mm thick. In other embodiments, the spacer layer 50 and the spacer material 72 can have different thicknesses suitable for the application.

Figure 10:
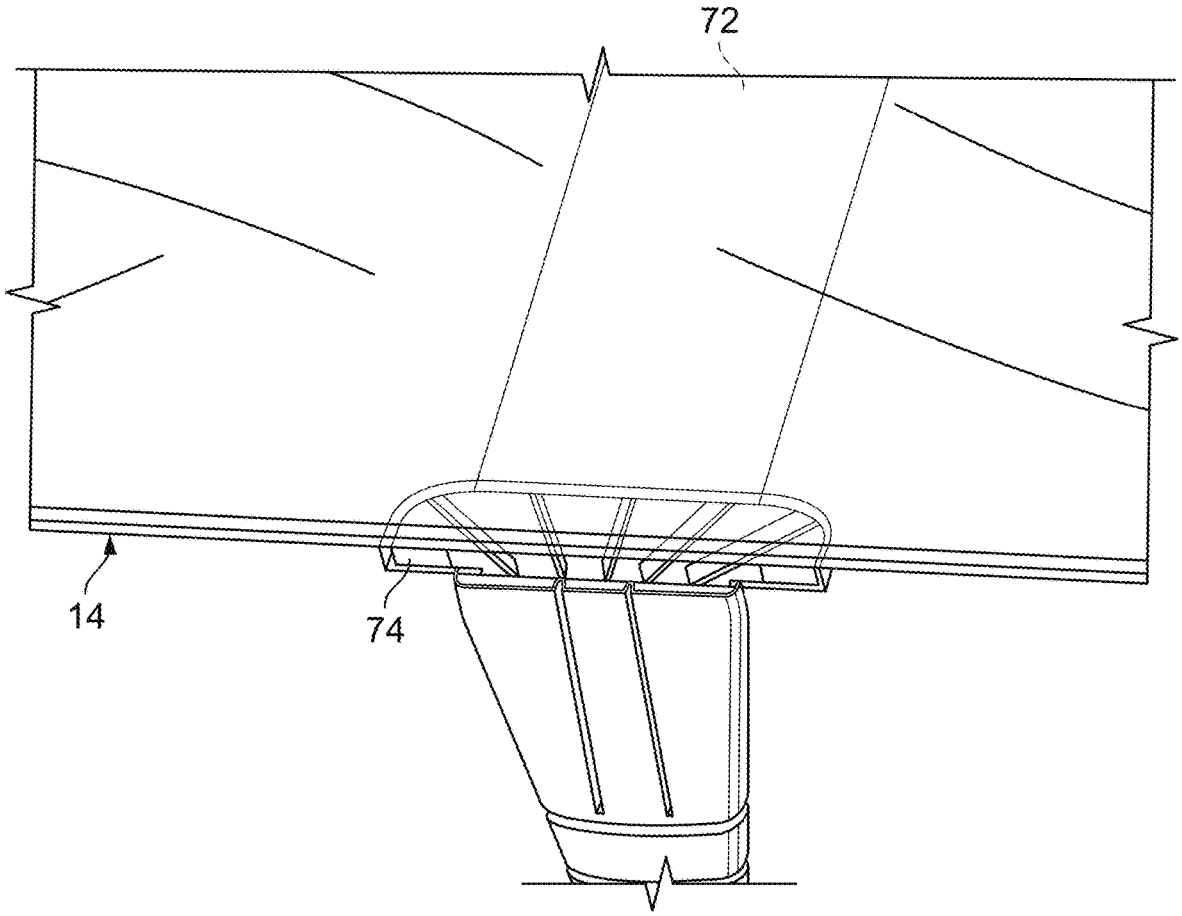
FIG. 10 is a perspective view of a portion of the layer assembly.

FIG. 10 is a perspective view of a portion of the layer assembly 14 with the distribution manifold 74 extending into the side of the layer assembly 14. As shown in FIGS. 8-10, the spacer layer 50, the distribution manifold 74, and the spacer material 72 can assist in directing air to portions of the user's body that benefit from cooling or heating. The distribution manifold 74 and the spacer material 72 can be positioned, oriented, and configured to direct at least some air toward further extremities of the layer assembly 14, which can reduce the tendency for the bulk of the air coming from the hose assembly 18 to exit the layer assembly 14 at a location proximate the connection point of the hose assembly 18 to the layer assembly 14.

Figure 11A:
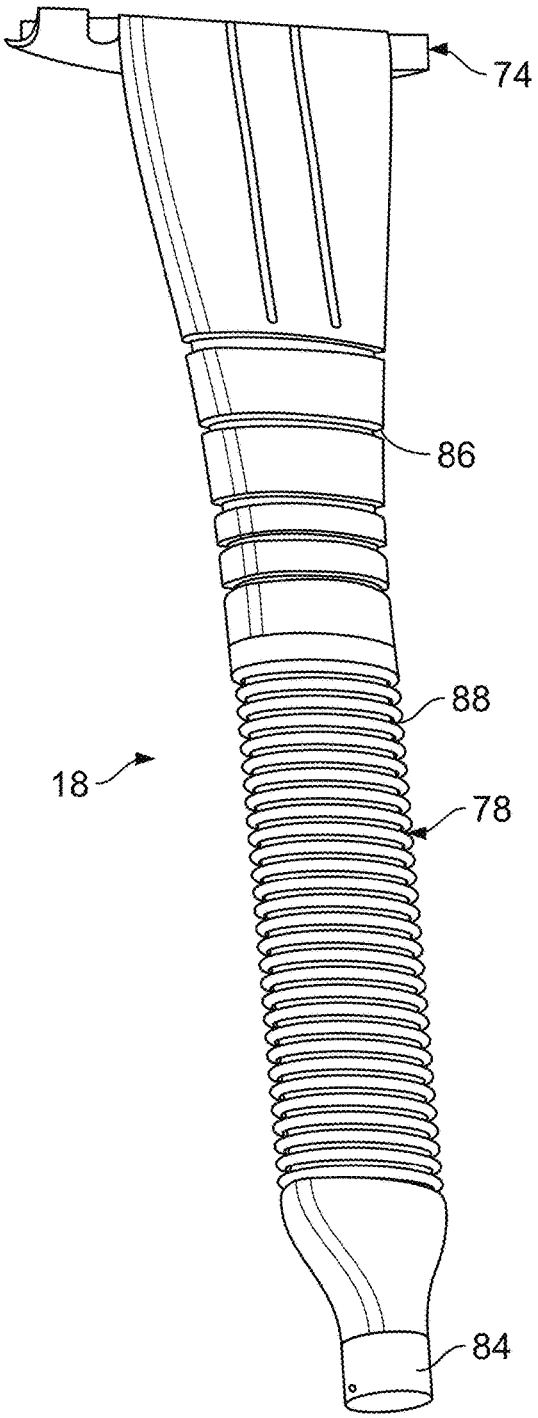
FIG. 11A is a perspective view of the hose assembly.
Figure 11B:
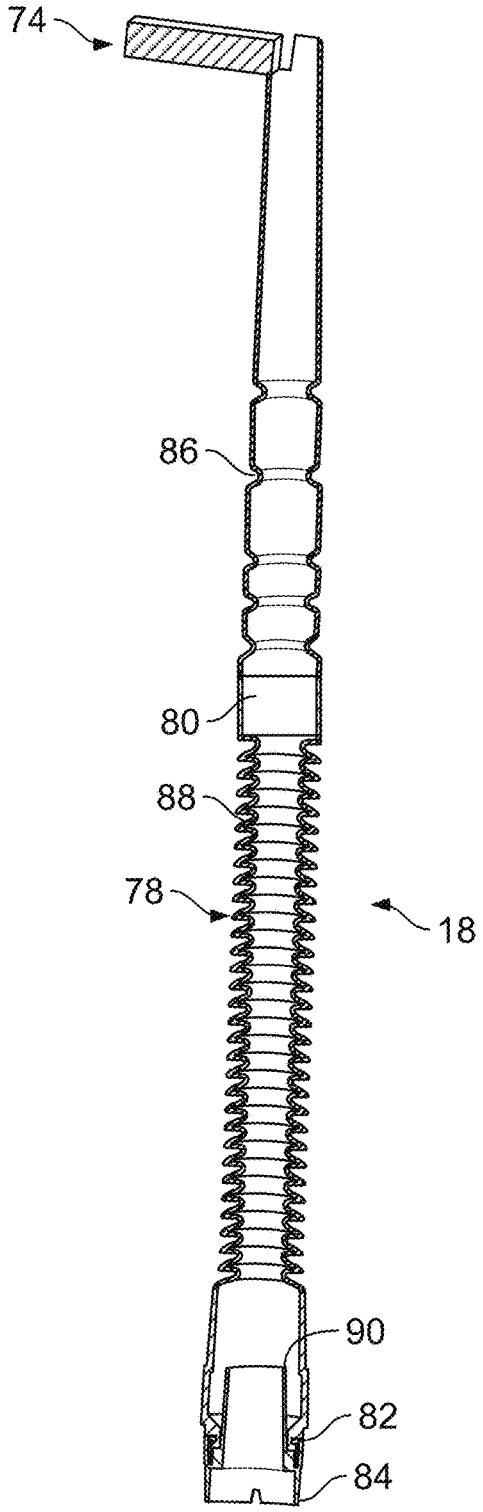
FIG. 11B is a sectional view of the hose assembly.

FIG. 11A is a perspective view of the hose assembly 18. FIG. 11B is a sectional view of the hose assembly 18. In some embodiments, the hose assembly 18 can include the distribution manifold 74, a hose 78, a connector 80 between the distribution manifold 74 and the hose 78, a swivel fitting 82, and an engine connector 84.

The distribution manifold 74 can include indented flex points 86 that allow for at least some flexibility of the distribution manifold 74. The hose 78 can also include indented flex points 88. For example, the hose 78 can be a bellows-style hose with a repeating series of alternating flex points 88 along the hose 78. This can allow the hose assembly 18 to expand and contract as well as to bend to accommodate the air system 12 being used in different applications.

The hose 78 connects to the engine 16 (shown in FIG. 1) via the engine connector 84 and the swivel fitting 82. The engine connector 84 can have a tapered nozzle 90 that extends into the hose 78 and is spaced from an inner surface of the hose 78 so that the tapered nozzle 90 does not touch the inner surface of the hose 78 during normal operation. Thus, the hose 78 can be moved with respect to the engine connector 84 without necessarily putting the most stress at the nozzle 90. Even if the hose 78 is pulled far enough that the nozzle 90 does contact the inner surface of the hose 78 and add some stress at that point, the total stress at that point can be reduced as compared to other possible designs.

Figure 12A:
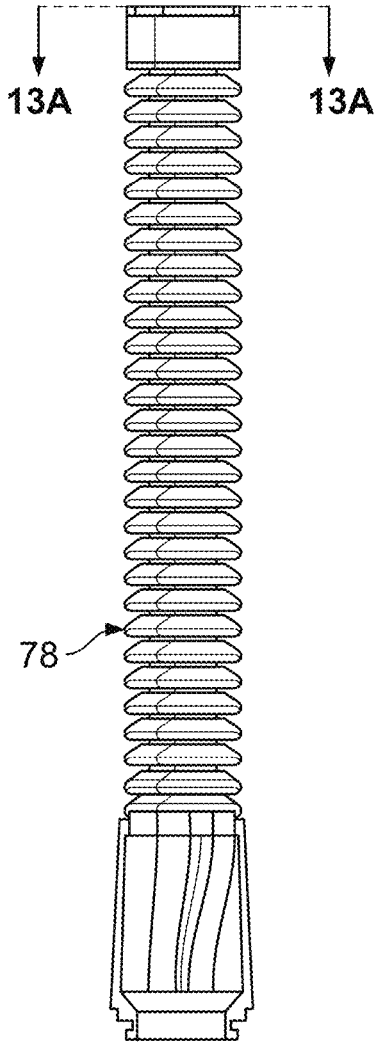
FIGS. 12A-12C are views of a portion of the hose assembly.
Figure 12B:
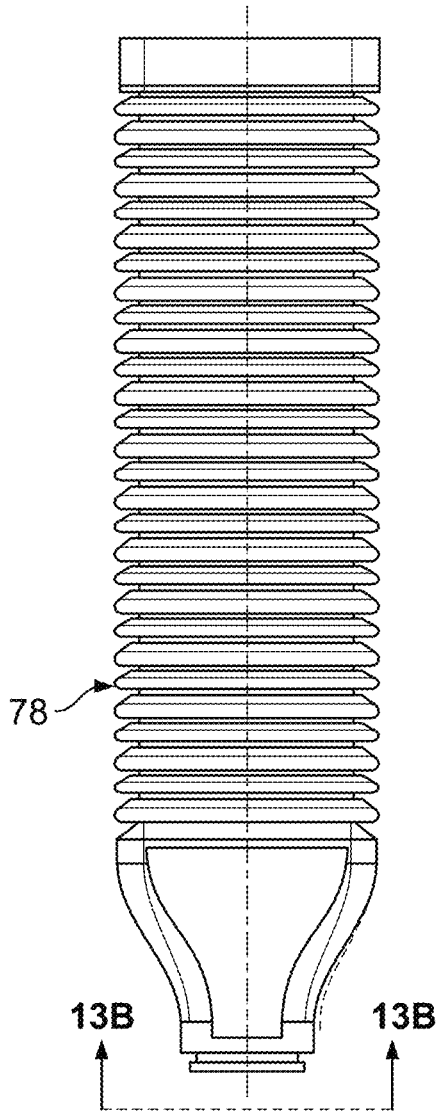
Figure 12C:
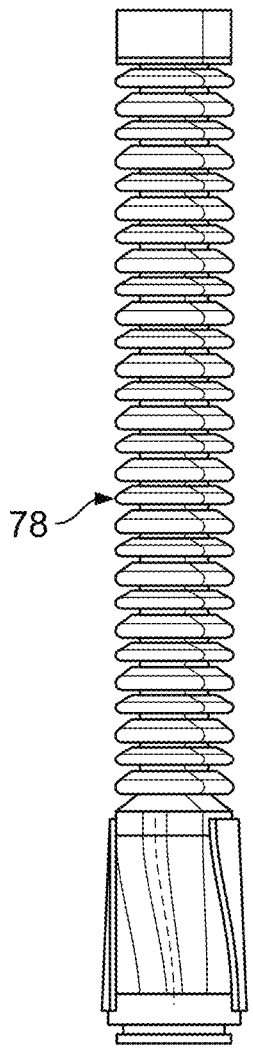

FIGS. 12A-12C are views of the hose 78 taken from three different sides.

Figure 13A:
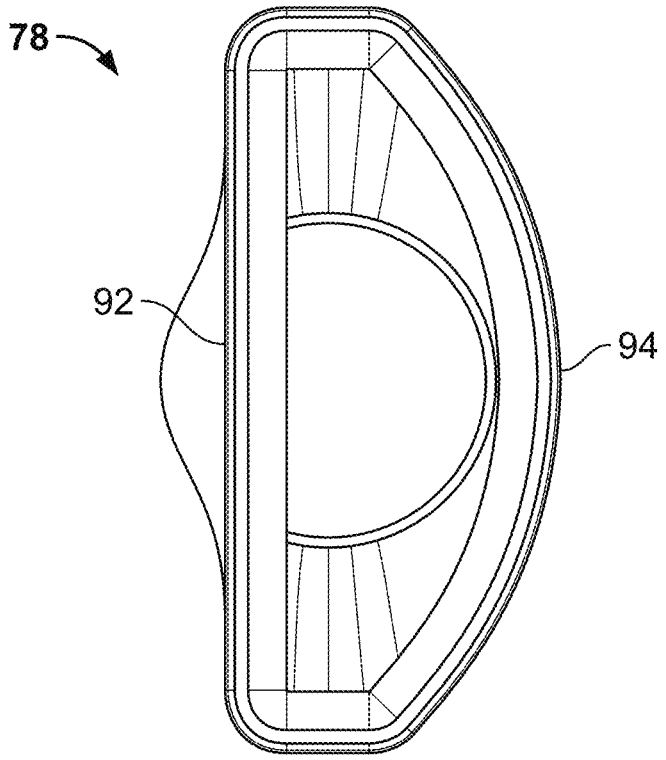
FIGS. 13A and 13B are top and bottom views of a portion of the hose assembly.
Figure 13B:
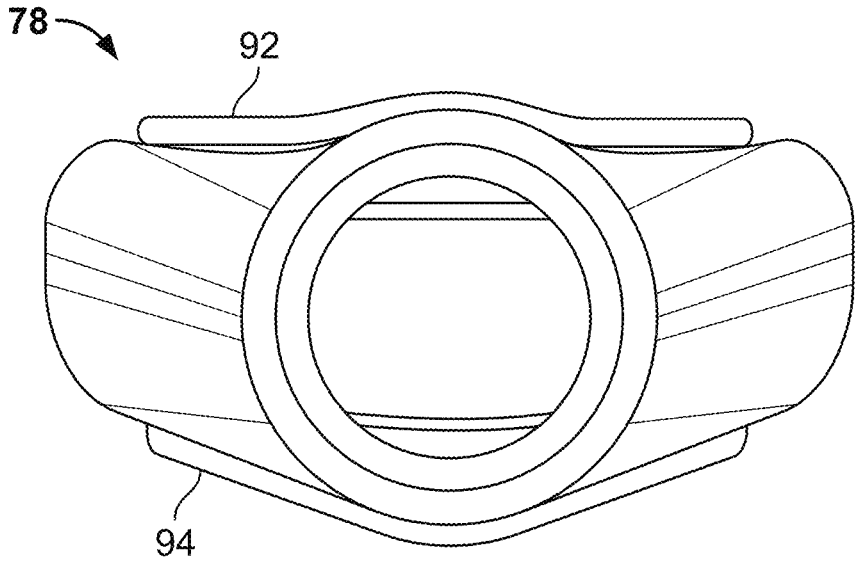

FIG. 13A is a top view of the hose 78 taken along line 13A-13A of FIG. 12A. As shown in FIG. 13A, the hose 78 can have a substantially D-shaped cross section, with a substantially straight portion 92 opposite a curved portion 94. The straight portion 92 of the hose 78 can allow the hose 78 to lay relatively flat against the bed 10. The curved portion 94 of the hose 78 can increase structural strength of the hose and decrease the chance of the hose 78 kinking and/or collapsing when bent or squished. For example, the D-shaped cross section can suitably resist collapsing of the hose 78 when used with tight-fitting sheets covering a portion of the hose 78. Such a D-shaped cross section can be particularly beneficial in applications where the hose 78 is made of a relatively soft material, such as silicone.

Figure 14:
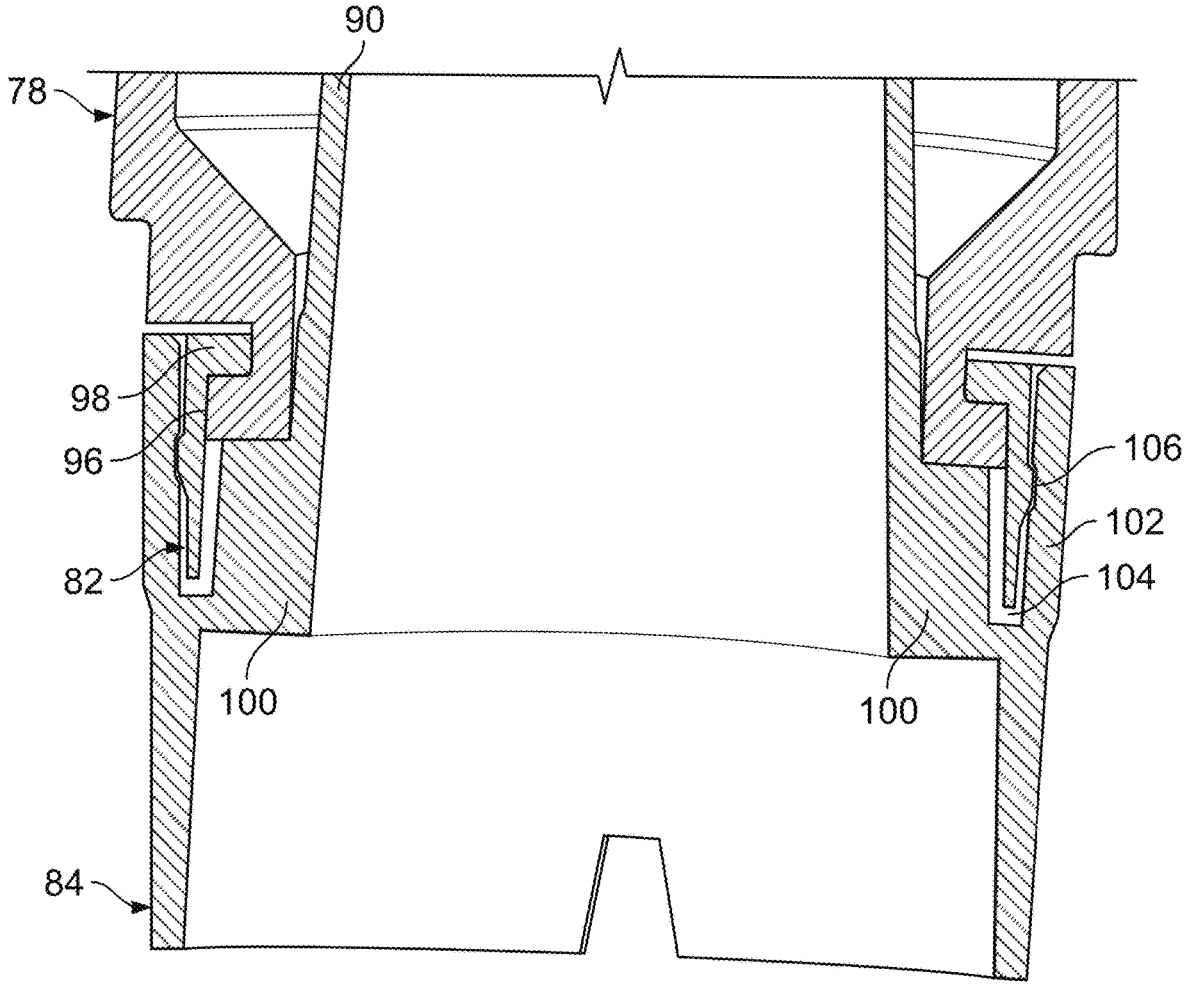
FIG. 14 is an enlarged sectional view from FIG. 11B of connection components at the bottom of the hose assembly.

FIG. 14 is an enlarged sectional view from FIG. 11B of connection components at the bottom of the hose assembly 18. As shown in FIG. 14, the hose 78 can be connected to the engine connector 84 via the swivel fitting 82. The hose 78 can have an annular ring 96 extending radially outward. The swivel fitting 82 can have an annular ring 98 extending radially inward. The end of the hose 78 can extend into the swivel fitting 82 such that the annular ring 96 of the hose 78 is retained against the engine connector 84.

The nozzle 90 of the engine connector 84 extends from a relatively thick inner ring 100. The engine connect 84 also has a thinner outer ring 102 positioned radially outward of the inner ring 100 so as to define an annular slot 104 between the outer ring 102 (on the outside) and the inner ring 100 and the nozzle 90 (on the inside). The swivel fitting 82 and the end of the hose 78 can be positioned in the slot 104 as illustrated with the swivel fitting 82 holding the ring 96 adjacent the nozzle 90 and the ring 100.

The radially outer surface of the swivel fitting 82 can engage with the radially inner surface of the ring 102 of the engine connector 84 via a snap fitting 106. The snap fitting 106 can be sized and toleranced to allow for rotational movement between the swivel fitting 82 and the engine connector 84. This can allow the hose 78 to swivel with respect to the engine 16. In some embodiments, the end of the hose 78, including its ring 96, can be sized to allow relative rotational movement between the hose and the swivel fitting 82 as well.

Figure 15A:
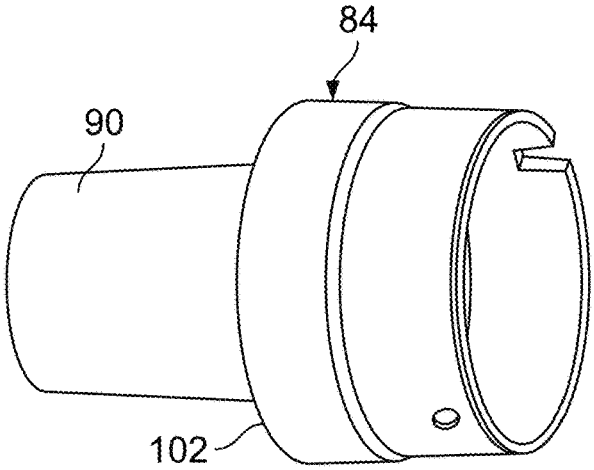
FIG. 15A is a perspective view of an engine connector.
Figure 15B:
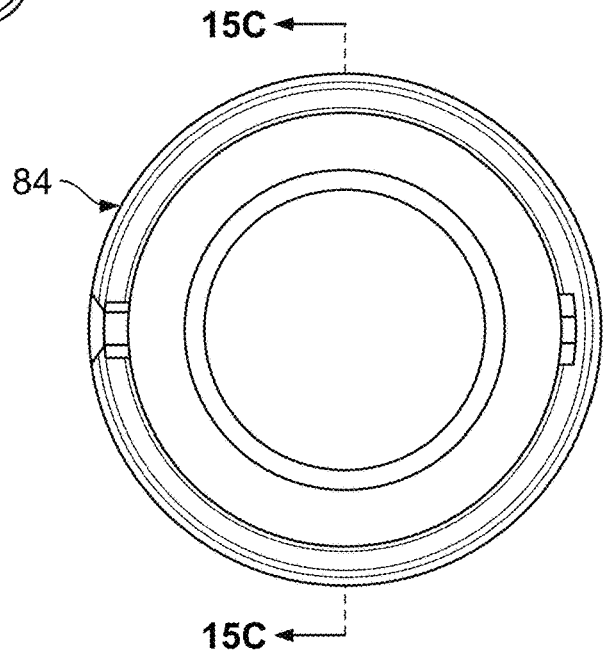
FIG. 15B is an end view of the engine connector.
Figure 15C:
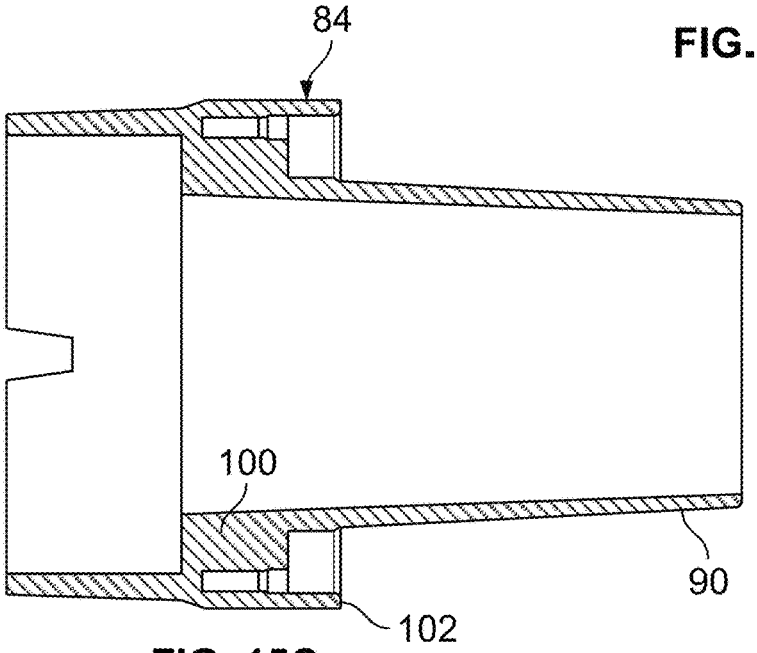
FIG. 15C is a sectional view of the engine connector taken along line 15C-15C of FIG. 15B.

FIG. 15A is a perspective view of the engine connector 84. FIG. 15B is an end view of the engine connector 84. FIG. 15C is a sectional view of the engine connector 84 taken along line 15C-15C of FIG. 15B. FIGS. 15A-15C show additional detail of the engine connector 84 described above.

Figure 16A:
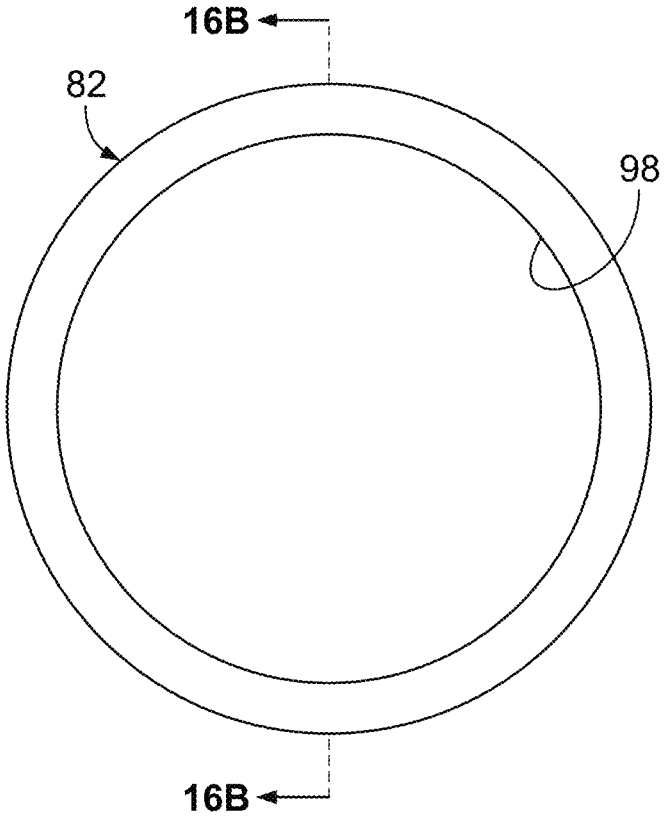
FIG. 16A is an end view of a swivel fitting.
Figure 16B:
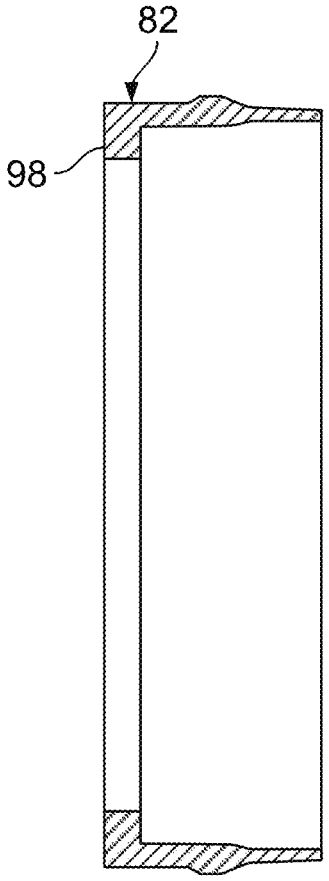
FIG. 16B is a sectional view of the swivel fitting taken along line 16B-16B of FIG. 16A.

FIG. 16A is an end view of the swivel fitting 82. FIG. 16B is a sectional view of the swivel fitting 82 taken along line 16B-16B of FIG. 16A. FIGS. 16A-16B show additional detail of the swivel fitting 82 described above.

Figure 17B:
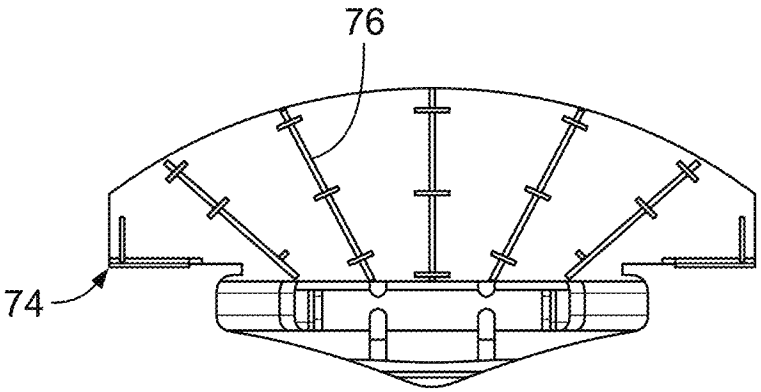
FIGS. 17A-17C are side, top, and bottom views, respectively, of the distribution manifold.
Figure 17C:
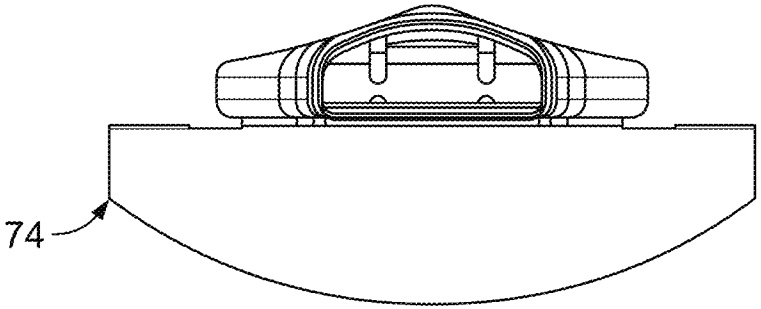
Figure 17A:
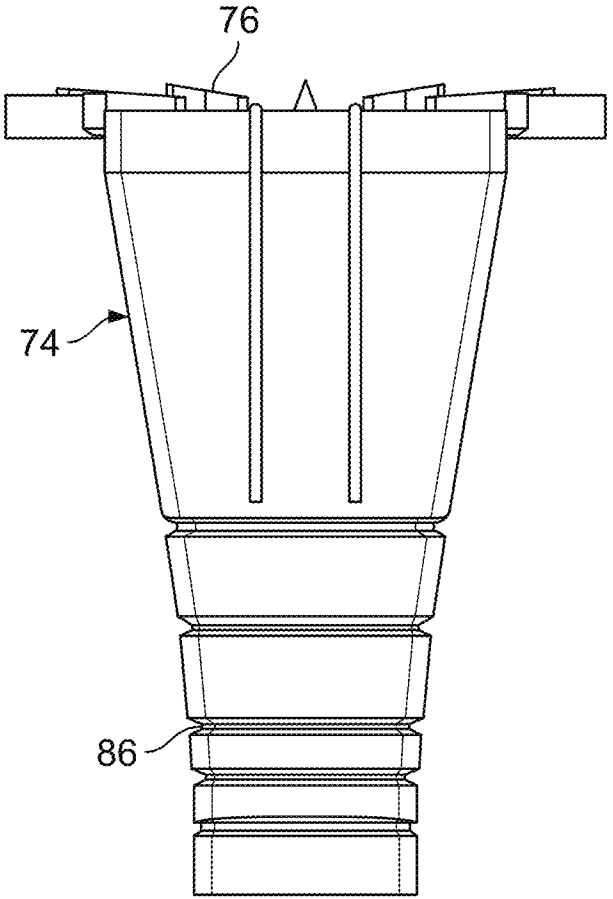

FIGS. 17A-17C are side, top, and bottom views, respectively, of the distribution manifold 74. FIGS. 17A-17C show additional detail of the distribution manifold 74 described above.

Figure 18:
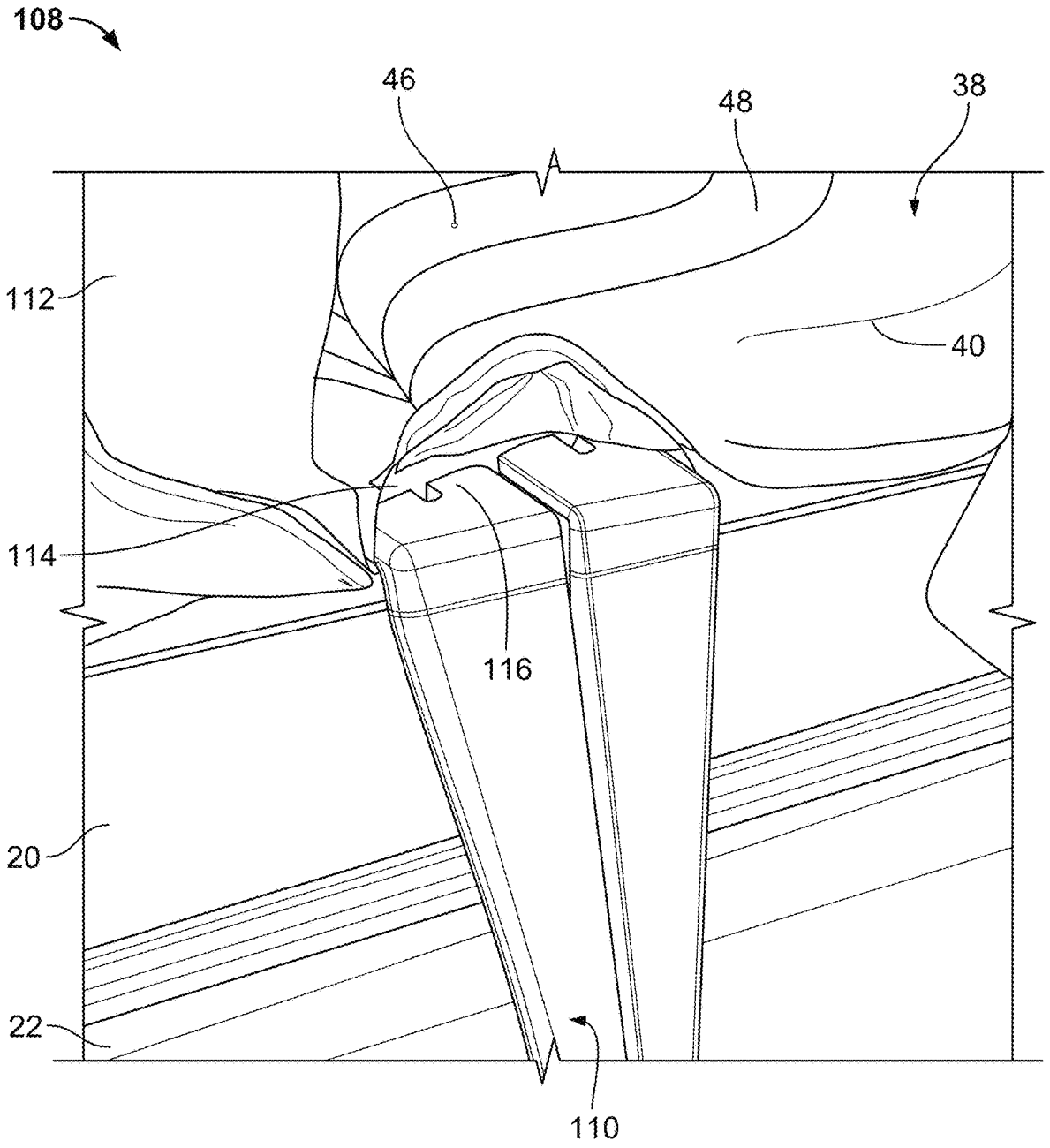
FIG. 18 is a perspective view of an alternative embodiment of an air system.

FIG. 18 is a perspective view of an alternative embodiment of an air system 108. The air system 108 includes the layer assembly 38 (also shown in FIG. 5), the engine 16 (also shown in FIG. 1), and a hose assembly 110 connecting the layer assembly 38 to the engine 16. In some embodiments, the air system 108 is like the air system 14 described above, with some similarities and differences.

For example, the air system 108 can include an additional fabric cover 112 that covers the layer assembly 38. The top layer 48 of the layer assembly 38 can be relatively air tight except for holes 46 that allow air to flow therethrough. The fabric cover 112 can be relatively air permeable to allow air flow therethrough without additional holes.

Additionally, the layer assembly 38 can have a spacer layer 114 that is aligned with an outlet of a distribution manifold 116 of the hose assembly 110 such that air from the distribution manifold 116 is blown directly into the side of the spacer layer 114. The spacer layer 114 can have a cut-out of a semi-circle or other suitable shape to correspond to the shape of the distribution manifold 116 and allow the distribution manifold 116 to extend into the layer assembly 38 at the same level as the spacer layer 114. The stitching 40 can be patterned in a manner suitable for directing air to different parts of the layer assembly 38 when air is blown directly into the side of the spacer layer 114 as shown and described.

As shown in FIG. 18, the cover 112 is partially pulled-back toward the left side of FIG. 18 to expose the layer assembly 38 at the middle and right of FIG. 18. Additionally, a portion of the top layer 48 of the layer assembly 38 is lifted at the distribution manifold 116 to show the shape of the distribution manifold 116 including the curved outlet of the distribution manifold 116 and how it is aligned with the spacer layer 114 to blow air directly into the side of the spacer layer 114 in the example shown.

Air systems as described herein provide a convenient, comfortable, and effective system to provide ambient or temperature controlled air to one or two users of a bed. Various embodiments can include unique features and advantages including relatively high air flow reliably delivered to appropriate locations for user comfort and effective connection mechanisms to securely and conveniently hold the system in place.

The foregoing detailed description and some embodiments have been given for clarity of understanding only. No unnecessary limitations are to be understood therefrom. It will be apparent to those skilled in the art that many changes can be made in the embodiments described without departing from the scope of the invention. For example, while the air system is described as delivering cooling or heating air in some embodiments, the air system can deliver ambient air in other embodiments. Additionally, while the shape and configuration of certain components can be beneficial for increasing air flow in certain embodiments, shape and configuration can be varied for those components in other embodiments. Thus, the scope of the present invention should not be limited to the exact details and structures described herein, but rather by the structures described by the language of the claims, and the equivalents of those structures. Any feature or characteristic described with respect to any of the above embodiments can be incorporated individually or in combination with any other feature or characteristic, and are presented in the above order and combinations for clarity only.

What is claimed is:

1. An air system for a bed, comprising:

a layer assembly having a head end, a foot end, and first and second sides, wherein the layer assembly has a head portion near the head end, a foot portion near the foot end, and a middle portion between the head portion and the foot portion, the layer assembly having:

a spacer layer comprising spacer material configured to allow for air flow through the spacer material;

a lower spacer material strip positioned at the middle portion of the layer assembly under the spacer layer; and a cover comprising a cover top layer and a cover bottom layer, wherein the cover substantially encloses the spacer layer with the cover top layer above the spacer layer and the cover bottom layer below the spacer layer; and a distribution manifold extending through a portion of the cover, wherein the distribution manifold is positioned above the cover bottom layer and under the spacer layer so as to flow air from the distribution manifold to a space under the spacer layer, from the space under the spacer layer into the spacer layer, and from the spacer layer out through the cover top layer, wherein an edge of the lower spacer material strip is aligned with an outlet of the distribution manifold, and wherein the distribution manifold has a first height that is thicker than a second height of the lower spacer material strip such that some air that exits from the distribution manifold flows under the lower spacer material strip and some air that exits from the distribution manifold flows into the edge of the lower spacer material strip, and wherein the distribution manifold has a first width that is wider than a second width of the lower spacer material strip such that some air that exits from the distribution manifold flow to the sides of the lower spacer material strip into spaces that are under the spacer layer and to sides of the lower spacer material strip in both head and foot directions.

2. The air system of claim 1 and further comprising:

a first flap extending from the head end and having a first retention feature; and a second flap extending from the foot end and having a second retention feature, wherein the air system is sized and configured such that when the layer assembly is positioned on a mattress the first and second flaps are each sized and configured to wrap around opposite ends of the mattress and tuck under the mattress with the first and second retention features being positioned under the mattress to at least partially retain the layer assembly on the mattress.

3. The air system of claim 2, wherein the layer assembly is configured to be positioned on a two-person mattress and sized to cover about half of a top surface of the mattress, and wherein the first and second flaps are suitable for retaining the layer assembly on the two-person mattress.

4. The air system of claim 2, wherein the distribution manifold is connected to the layer assembly proximate the first side, the air system further comprising:

one or more connectors connected to the layer assembly proximate the second side, wherein the one or more connectors are configured to connect the second side of the layer assembly to a side of a second layer assembly.

5. The air system of claim 1, wherein the distribution manifold is connected to the layer assembly proximate the first side, the air system further comprising:

a plurality of buttons connected to the layer assembly proximate the second side and positioned at least partially under the layer assembly; and a plurality of loops positioned proximate the second side of the layer assembly, wherein the plurality of loops are positioned with respect to the plurality of buttons such that the plurality of loops can connect to buttons of a second layer assembly that is configured similar to the layer assembly and the plurality of buttons can connect to loops of the second layer assembly so as to interconnect the layer assembly with the second layer assembly.

6. A bed system, comprising:

an adjustable foundation;

a mattress positioned on the adjustable foundation;

the air system of claim 1, wherein the layer assembly is positioned on top of the mattress on a first side of the mattress with the second side of the layer assembly substantially aligned with a middle of the mattress, wherein the distribution manifold is connected to the layer assembly at the first side of the layer assembly proximate a side of the mattress such that the distribution manifold hangs down along at least a portion of the side of the mattress.

7. The bed system of claim 6, wherein the air system further comprises:

a first flap extending from the head end and having a first retention feature positioned under the mattress;

a second flap extending from the foot end and having a second retention feature positioned under the mattress;

an air engine configured to deliver air; and a hose assembly connecting the air engine to the layer assembly via the distribution manifold, wherein the bed system further comprises:

a fitted mattress cover that at least partially covers the mattress, the layer assembly, the first flap, the second flap, and the distribution manifold, wherein the layer assembly, the first flap, the second flap, and the distribution manifold are positioned between the fitted mattress cover and the mattress, wherein the fitted mattress cover coverts head, foot, left, and right sides of the mattress.

8. The air system of claim 1, and further comprising means for delivering air to the layer assembly.

9. The air system of claim 1, and further comprising means for connecting the layer assembly to a bed.

10. The air system of claim 1, and further comprising means for defining flow paths through the layer assembly.

11. The air system of claim 1, wherein the distribution manifold comprises a vertically-extending portion and a horizontally extending portion connected to the vertically-extending portion at a top of the vertically-extending portion, wherein the vertically-extending portion defines a flow path with a larger cross-sectional area at the top of the vertically-extending portion than at a bottom of the vertically-extending portion, and wherein the horizontally-extending portion includes a plurality of walls aligned at different angles that define a plurality of channels between the plurality of walls and that are configured to deliver air received from the vertically-extending portion of the distribution manifold out into the layer assembly at different angles as defined by the plurality of walls.

12. The air system of claim 1, wherein the distribution manifold is positioned in the middle portion of the layer assembly at the first side of the layer assembly, and wherein the distribution manifold is aligned with the lower spacer material such that at least part of the air blown out of the distribution manifold is blown into the lower spacer material.

13. The air system of claim 1, wherein the lower spacer material is an elongated strip extending from a first lower spacer end proximate the distribution manifold to a second lower spacer end proximate the second side of the layer assembly, wherein the spacer layer extends substantially from the head end to the foot end and from the first side to the second side of the layer assembly, and wherein the lower spacer material is configured to receive air from the distribution manifold and allow air flow through the lower spacer material such that some air flows from the lower spacer material into the spacer layer proximate the second side of the layer assembly, some air flows from the lower spacer material into the spacer layer proximate the first side of the layer assembly, and some air flows from the lower spacer material into the spacer layer between the first and second sides of the layer assembly.

14. The air system of claim 1, and further comprising:

an air engine; and a hose assembly connecting the air engine to the layer assembly via the distribution manifold, wherein the hose assembly has a substantially D-shaped cross section with a substantially straight portion opposite a curved portion such that the curved portion faces away from the layer assembly when the hose assembly is connected.

15. The air system of claim 1, and further comprising:

means for connecting the hose assembly to the air engine to allow for the hose assembly to swivel with respect to the air engine and to decrease the chance of kinking of the hose assembly.

16. The air assembly of claim 1, wherein the layer assembly further comprises stitching extending through the cover top layer, the cover bottom layer, and the spacer layer in a pattern that defines flow paths from the distribution manifold, wherein the stitching is patterned with one or more lines that cross the middle portion of the layer assembly so as to restrict flow from the distribution manifold at the first side to the second side of the layer assembly, wherein the cover top layer defines a first set of holes extending through the cover top layer between the first side and the one or more lines that cross the middle portion of the layer assembly, and wherein the cover top layer defines a second set of holes extending through the cover top layer between the second side and the one or more lines that cross the middle portion of the layer assembly.

17. An air system for a bed, comprising:

a layer assembly having a head end, a foot end, and first and second sides, wherein the layer assembly has a head portion near the head end, a foot portion near the foot end, and a middle portion between the head portion and the foot portion, the layer assembly having:

a spacer layer comprising spacer material configured to allow for air flow through the spacer material; and a cover comprising a cover top layer and a cover bottom layer, wherein the cover substantially encloses the spacer layer with the cover top layer above the spacer layer and the cover bottom layer below the spacer layer; and a distribution manifold extending through a portion of the cover, wherein the distribution manifold is positioned above the cover bottom layer and under the spacer layer so as to flow air from the distribution manifold to a space under the spacer layer, from the space under the spacer layer into the spacer layer, and from the spacer layer out through the cover top layer, wherein the layer assembly further comprises a lower spacer material positioned at the middle portion of the layer assembly that is aligned with the distribution manifold under the spacer layer, wherein the layer assembly further comprises stitching extending through the cover top layer, the cover bottom layer, and the spacer layer in a pattern that defines flow paths from the distribution manifold, wherein the stitching is patterned with one or more lines that also stitch at least partially into the lower spacer material but without entirely crossing the lower spacer material.

18. The air system of claim 17, wherein the layer assembly has a first width from the first side to the second side of the layer assembly, wherein the first flap has a second width from a first flap side to a second flap side at a connection end where the first flap connects to the head end of the layer assembly, wherein the first flap has a third width from the first flap side to the second flap side at a distal end of the first flap, wherein the first width is greater than the second width, and wherein the second width is greater than the third width.

19. The air system of claim 17, wherein the cover defines an air inlet into the layer assembly.

20. The air system of claim 17, wherein the distribution manifold is substantially fan-shaped with a plurality of walls aligned at different angles that define channels between the walls so as to distribute air into the layer assembly at the different angles toward the head portion, the middle portion, and the foot portion.

21. The air system of claim 17, wherein the cover top layer defines a first set of holes extending through the cover top layer between the first side and the one or more lines that cross the middle portion of the layer assembly, and wherein the cover top layer defines a second set of holes extending through the cover top layer between the second side and the one or more lines that cross the middle portion of the layer assembly.

* * * * *